US009120616B2

(12) United States Patent
Ware et al.

(10) Patent No.: US 9,120,616 B2
(45) Date of Patent: Sep. 1, 2015

(54) LIQUID DISPENSING SYSTEMS ENCOMPASSING GAS REMOVAL

(71) Applicant: Advanced Technology Materials, Inc., Danbury, CT (US)

(72) Inventors: Donald D. Ware, Woodbury, MN (US); Glenn M. Tom, Bloomington, MN (US); Paul Dathe, Plymouth, MN (US); Amy Koland, Eden Prairie, MN (US); Jason Gerold, Shakopee, MN (US); Kirk Mikkelsen, Chanhassen, MN (US); Kevin T. O'Dougherty, Arden Hills, MN (US); Michael A. Cisewski, Hutchinson, MN (US)

(73) Assignee: Advanced Technology Materials, Inc., Billerica, MA (US)

( * ) Notice: Subject to any disclaimer, the term of this patent is extended or adjusted under 35 U.S.C. 154(b) by 0 days.

(21) Appl. No.: 13/713,078

(22) Filed: Dec. 13, 2012

(65) Prior Publication Data

US 2013/0168410 A1 Jul. 4, 2013

Related U.S. Application Data

(63) Continuation of application No. 12/304,765, filed as application No. PCT/US2007/070911 on Jun. 11, 2007, now Pat. No. 8,336,734.

(60) Provisional application No. 60/813,083, filed on Jun. 13, 2006, provisional application No. 60/829,623, filed on Oct. 16, 2006, provisional application No. 60/887,194, filed on Jan. 30, 2007.

(51) Int. Cl.

| | |
|---|---|
| ***B65D 83/62*** | (2006.01) |
| ***B67D 7/02*** | (2010.01) |
| ***B67D 7/76*** | (2010.01) |

(52) U.S. Cl.
CPC ..... *B65D 83/62* (2013.01); *B67D 7/0261* (2013.01); *B67D 7/763* (2013.01); *Y10T 137/313* (2015.04)

(58) Field of Classification Search
CPC ..... B65D 83/62; B67D 7/0261; B67D 7/763
USPC ..... 222/1, 61, 95, 105
See application file for complete search history.

(56) References Cited

U.S. PATENT DOCUMENTS

| | | | |
|---|---|---|---|
| 3,054,401 | A | 9/1962 | Gewecke |
| 3,682,355 | A | 8/1972 | Lo |

(Continued)

FOREIGN PATENT DOCUMENTS

| | | | |
|---|---|---|---|
| CN | 1741249 | A | 3/2006 |
| JP | 05-103921 | A | 4/1993 |

(Continued)

OTHER PUBLICATIONS

Lorefice, Bob, et al., "How to Minimize Resist Usage During Spin Coating", "Semiconductor International; found online Sep. 26, 2006 at http://www.reedlectronics.com/semiconductor/article/CA164074?pubdate=6%2F1%2F1998", Jun. 1, 1998.

*Primary Examiner* — J. Casimer Jacyna
(74) *Attorney, Agent, or Firm* — Christensen Fonder P.A.

(57) ABSTRACT

Systems are described for delivery of a wide variety of materials in which liquid and gas or vapor states are concurrently present, from a package preferably including a fluid-containing collapsible liner. Headspace gas is removed from a pressure dispensing package prior to liquid dispensation therefrom, and ingress gas is removed thereafter during dispensation operation. At least one sensor senses presence of gas or a gas-liquid interface in a reservoir or gas-liquid separation region. A gas removal system including an integral reservoir, at least one sensor, and at least one flow control elements may be included within a connector adapted to mate with a pressure dispensing package, for highly efficient removal of gas from the liquid being dispensed from the container.

22 Claims, 20 Drawing Sheets

(56) References Cited

U.S. PATENT DOCUMENTS

| | | | | |
|---|---|---|---|---|
| 3,756,367 | A | 9/1973 | Mitchell et al. | |
| 3,802,470 | A | 4/1974 | Coleman | |
| 4,138,036 | A | 2/1979 | Bond | |
| 4,313,419 | A | 2/1982 | Lyon et al. | |
| 4,784,643 | A | 11/1988 | Siretchi et al. | |
| 5,014,208 | A | 5/1991 | Wolfson | |
| 5,102,010 | A | 4/1992 | Osgar et al. | |
| 5,148,945 | A | 9/1992 | Geatz | |
| 5,217,053 | A | 6/1993 | Foster et al. | |
| 5,223,796 | A | 6/1993 | Waldman et al. | |
| 5,277,336 | A | 1/1994 | Youel | |
| 5,335,821 | A | 8/1994 | Osgar | |
| 5,385,060 | A | 1/1995 | Wang | |
| 5,435,460 | A | 7/1995 | Osgar | |
| 5,526,956 | A | 6/1996 | Osgar | |
| 5,558,083 | A | 9/1996 | Bathe et al. | |
| 5,594,162 | A | 1/1997 | Dolan et al. | |
| 5,604,681 | A | 2/1997 | Koeninger | |
| 5,627,517 | A | 5/1997 | Theimer et al. | |
| 5,635,652 | A | 6/1997 | Beaudin | |
| 5,638,285 | A | 6/1997 | Newton | |
| 5,693,017 | A | 12/1997 | Spears et al. | |
| 5,744,696 | A | 4/1998 | Wang et al. | |
| 5,764,522 | A | 6/1998 | Shalev | |
| 5,802,859 | A | 9/1998 | Zugibe | |
| 5,875,921 | A | 3/1999 | Osgar et al. | |
| 5,891,096 | A | 4/1999 | Hyun et al. | |
| 5,942,980 | A | 8/1999 | Hoben et al. | |
| 5,957,328 | A | 9/1999 | Osgar | |
| 5,988,422 | A | 11/1999 | Vallot | |
| 6,021,921 | A | 2/2000 | Lan et al. | |
| 6,065,638 | A | 5/2000 | Terranova et al. | |
| 6,067,844 | A | 5/2000 | Westbrook et al. | |
| 6,089,027 | A | 7/2000 | Wang et al. | |
| 6,165,347 | A | 12/2000 | Warburton | |
| 6,168,048 | B1 * | 1/2001 | Xu et al. | 222/1 |
| 6,206,240 | B1 | 3/2001 | Osgar et al. | |
| 6,234,006 | B1 | 5/2001 | Sunshine et al. | |
| 6,237,809 | B1 | 5/2001 | Kawai et al. | |
| 6,264,064 | B1 | 7/2001 | Birtcher et al. | |
| 6,276,565 | B1 | 8/2001 | Parsons et al. | |
| 6,345,739 | B1 | 2/2002 | Mekata | |
| 6,405,745 | B1 | 6/2002 | Kar et al. | |
| 6,435,224 | B2 | 8/2002 | Blatt et al. | |
| 6,446,644 | B1 | 9/2002 | Dolechek | |
| 6,460,730 | B1 | 10/2002 | Liedtke | |
| 6,516,249 | B1 | 2/2003 | Hoyle et al. | |
| 6,542,848 | B1 | 4/2003 | Neeser et al. | |
| 6,556,949 | B1 | 4/2003 | Lyon | |
| 6,629,627 | B1 * | 10/2003 | Siegele et al. | 222/464.1 |
| 6,648,201 | B1 | 11/2003 | Marinaro et al. | |
| 6,649,829 | B2 | 11/2003 | Garber et al. | |
| 6,732,945 | B2 | 5/2004 | Dolechek | |
| 6,843,414 | B2 | 1/2005 | Madrid et al. | |
| 6,879,876 | B2 | 4/2005 | O'Dougherty et al. | |
| 7,156,132 | B2 | 1/2007 | O'Dougherty et al. | |
| 7,188,644 | B2 | 3/2007 | Kelly et al. | |
| 8,322,571 | B2 | 12/2012 | Hovinen et al. | |
| 8,336,734 | B2 | 12/2012 | Ware et al. | |
| 2002/0092582 | A1 | 7/2002 | Hennan et al. | |
| 2003/0004608 | A1 | 1/2003 | O'Dougherty et al. | |
| 2003/0168479 | A1 | 9/2003 | Lu et al. | |
| 2003/0190272 | A1 | 10/2003 | Raine et al. | |
| 2003/0205581 | A1 | 11/2003 | Wertenberger | |
| 2004/0058453 | A1 | 3/2004 | Free et al. | |
| 2004/0172160 | A1 | 9/2004 | O'Dougherty et al. | |
| 2005/0087237 | A1 | 4/2005 | O'Dougherty et al. | |
| 2005/0150940 | A1 | 7/2005 | Nakamura | |
| 2005/0177274 | A1 | 8/2005 | O'Dougherty et al. | |
| 2005/0279207 | A1 | 12/2005 | O'Dougherty et al. | |
| 2006/0042756 | A1 | 3/2006 | Miyazaki et al. | |
| 2006/0146103 | A1 | 7/2006 | Nakamura | |
| 2009/0020176 | A1 | 1/2009 | Hasegawa et al. | |
| 2010/0112815 | A1 | 5/2010 | O'Dougherty et al. | |
| 2010/0133292 | A1 | 6/2010 | Ware et al. | |

FOREIGN PATENT DOCUMENTS

| | | | |
|---|---|---|---|
| JP | 06-247499 | A | 9/1994 |
| JP | 09-066228 | A | 3/1997 |
| JP | 2000-015082 | A | 1/2000 |
| JP | 2005/103921 | A | 4/2005 |
| JP | 2007-204102 | A | 8/2007 |
| JP | 2007/258367 | A | 10/2007 |
| KR | 10-0385555 | B1 | 5/2003 |
| KR | 10-0438101 | B1 | 6/2004 |
| KR | 200418728 | Y1 | 6/2006 |
| TW | 371774 | | 10/1999 |
| TW | 503094 | B | 9/2002 |
| TW | 509970 | B | 11/2002 |
| WO | WO-9503245 | A1 | 2/1995 |
| WO | WO-9956057 | A1 | 11/1999 |
| WO | WO-0054724 | A2 | 9/2000 |
| WO | WO-03093109 | A1 | 11/2003 |
| WO | WO 2005/100203 | A2 | 10/2005 |
| WO | WO-2005100203 | A2 | 10/2005 |
| WO | WO-2007061967 | A2 | 5/2007 |
| WO | WO-2007088661 | A1 | 8/2007 |
| WO | WO-2008000574 | A1 | 1/2008 |

* cited by examiner

LIQUID DISPENSING SYSTEMS ENCOMPASSING GAS REMOVAL

STATEMENT OF RELATED APPLICATIONS

This application is a continuation of U.S. patent application Ser. No. 12/304,765 filed on Dec. 14, 2008 as the U.S. national phase under the provisions of 35 U.S.C. §371 of International Patent Application No. PCT/US07/70911 filed on Jun. 11, 2007, which in turn claims benefit of each of U.S. Provisional Patent Application No. 60/813,083 filed on Jun. 13, 2006, U.S. Provisional Patent Application No. 60/829,623 filed on Oct. 16, 2006, and U.S. Provisional Patent Application No. 60/887,194 filed on Jan. 30, 2007. The disclosures of each of the foregoing international patent application and U.S. patent applications are hereby incorporated by reference herein in their respective entireties, for all purposes.

FIELD OF THE INVENTION

The present invention relates to dispensing systems, such as are utilized to effect supply of fluid materials for use thereof. In a specific aspect, the invention relates to pressure-dispensing systems, wherein liquid or other fluid material is discharged from a source vessel by displacement with a pressurized medium, e.g., air or liquid, and to associated aspects relating to fabrication, operational processes, and deployment of such systems.

DESCRIPTION OF THE RELATED ART

In many industrial applications, chemical reagents and compositions are required to be supplied in a high purity state, and specialized packaging has been developed to ensure that the supplied material is maintained in a pure and suitable form, throughout the package fill, storage, transport, and ultimate dispensing operations.

In the field of microelectronic device manufacturing, the need for suitable packaging is particularly compelling for a wide variety of liquids and liquid-containing compositions, since any contaminants in the packaged material, and/or any ingress of environmental contaminants to the contained material in the package, can adversely affect the microelectronic device products that are manufactured with such liquids or liquid-containing compositions, rendering the microelectronic device products deficient or even useless for their intended use.

As a result of these considerations, many types of high-purity packaging have been developed for liquids and liquid-containing compositions used in microelectronic device manufacturing, such as photoresists, etchants, chemical vapor deposition reagents, solvents, wafer and tool cleaning formulations, chemical mechanical polishing compositions, color filtering chemistries, overcoats, liquid crystal materials, etc.

One type of high-purity packaging that has come into such usage includes a rigid or semi-rigid overpack containing a liquid or liquid-based composition in a flexible liner or bag that is secured in position in the overpack by retaining structure such as a lid or cover. Such packaging is commonly referred to as "bag-in-can" (BIC), "bag-in-bottle" (BIB) and "bag-in-drum" (BID) packaging. Packaging of such general type is commercially available under the trademark NOWPAK from ATMI, Inc. (Danbury, Conn., USA). Preferably, a liner comprises a flexible material, and the overpack container comprises a wall material that is substantially more rigid than said flexible material. The rigid or semi-rigid overpack of the packaging may for example be formed of a high-density polyethylene or other polymer or metal, and the liner may be provided as a pre-cleaned, sterile collapsible bag of a polymeric film material, such as polytetrafluoroethylene (PTFE), low-density polyethylene, PTFE-based multilaminates, polyamide, polyester, polyurethane, or the like, selected to be inert to the contained liquid or liquid-based material to be contained in the liner. Multilayer laminates comprising any of the foregoing materials may be used. Exemplary materials of construction of a liner further include: metallized films, foils, polymers/copolymers, laminates, extrusions, co-extrusions, and blown and cast films. Packaging of such general type is commercially available under the trademark NOWPAK from ATMI, Inc. (Danbury, Conn., USA).

In the dispensing operation involving such liner packaging of liquids and liquid-based compositions, the liquid is dispensed from the liner by connecting a dispensing assembly including a dip tube, or short probe, to a port of the liner, with the dip tube being immersed in the contained liquid. After the dispensing assembly has been thus coupled to the liner, fluid, e.g., gas, pressure is applied on the exterior surface of the liner, so that it progressively collapses and forces liquid through the dispensing assembly for discharge to associated flow circuitry for flow to an end-use site.

Headspace (extra air at the top of a liner) and microbubbles present a significant process problem for liquid dispensing from liner-based packages, e.g., in panel display (FPD) and integrated circuit (IC) manufacturing facilities. The headspace gas may derive from the filling operation, in which the package is less than completely filled with the liquid. Less than complete filling of the package is often necessary in order to provide a headspace as an expansion volume, to accommodate changes in the ambient environment of the package, such as temperature changes that cause the liquid to expand during package transport to the location at which the package is placed in service for dispensing of the liquid.

As a result, gas from the headspace may become entrained in the dispensed liquid and produce a heterogeneous, a multiphase dispensed fluid stream that is deleterious to the process or product for which the dispensed liquid is being utilized. Further, the presence of gas from the headspace in the dispensed liquid can result in a malfunctioning or error in operation of fluid flow sensors, flow controllers, and the like.

A related problem, incident to the use of packages containing liquid compositions, is permeation or in-leakage of gas into the contained liquid and solubilization and bubble formation in the liquid. In the case of liner-based packages, gases exterior to the liner may permeate through the liner into the contained liquid. Where liner-based packages are utilized for pressure dispense operation, the pressurizing gas itself, e.g., air or nitrogen, may permeate through the liner material and become dissolved in the liquid in the liner. When the liquid subsequently is dispensed, pressure drop in the dispensing lines and downstream instrumentation and equipment may cause liberation of formerly dissolved gas, resulting in the formation of bubbles in the stream of dispensed liquid, with consequent adverse effect analogous to those resulting from entrained headspace gas. It would therefore be desirable to remove headspace gas prior to initial dispensation, and provide for continued removal of liberated gas after liquid dispensation has commenced. It would be further desirable to accomplish gas removal rapidly while reducing the potential for microbubble formation.

In the manufacture of semiconductor and other microelectronic products, the presence of bubbles, even those of microscopic size (microbubbles), can result in an integrated circuit or flat-panel display being deficient or even useless for its intended purpose. It therefore is imperative that all such extraneous gas be removed from the liquid utilized for the manufacture of such products.

In the use of a typical liner-based package, the user pressurizes the package and opens a venting valve to allow headspace gas to flow out of the liner. When liquid enters the headspace gas discharge line, after the headspace gas is exhausted, a sensor shuts off the gas venting valve and opens another valve to dispense only liquid in a liquid discharge line. When the package signals an empty detect condition, e.g., by monitoring of pressure of the dispensed fluid, and detection of a pressure droop in the pressure as a function of time, the connector or other coupling device joined to the vessel containing the liner can be removed from the exhausted vessel, and placed on a fresh (e.g., full) container, to provide for continued dispensing operation. Since there is liquid in the headspace removal line, a timer operates to bypass the liquid sensor until headspace gas arrives again, subsequent to which the liquid reenters the vent line and the sensor is "re-activated" with the timer to close the vent valve.

This arrangement, however, is susceptible to failure modes involving occurrence of the following events: (i) the timer is not set correctly and transmits a false signal indicating that the headspace has been removed; (ii) headspace varies from one filled package to another, and settings that are selected for one package are not appropriate for another, so that the headspace gas is not correctly removed; (iii) bubbles present in the headspace gas vent line create a false indication of headspace gas removal; and (iv) remaining (previously present) liquid in the headspace vent line can give a false indication of headspace gas removal.

Although integrated reservoirs can be used to eliminate microbubbles and headspace, such provision involves increased capital cost and hydrodynamic flow complexities and operational difficulties. Microbubbles are particularly problematic because of their tendency to migrate through permeable liner films while under pressure for pressure dispensing.

It has been established that the provision of a minimal, and preferably zero, headspace in the liner package is advantageous in order to suppress generation of particles and microbubbles in the liquid or liquid-based composition. Minimal, and preferably zero, headspace in the package liner also is advantageous to correspondingly minimize or eliminate the ingress of headspace gas into liquid or liquid-based composition.

Additionally, in the storage and dispensing of liquids and liquid-based compositions from liner packages, it is desirable to manage the dispensing operation so that the depletion or approach to depletion of the dispensed material is detected so that termination of a downstream operation, or switchover to a fresh package of material, is able to be timely effected. Reliability in end-stage monitoring of the dispensing operation, and particularly in detection of an empty or approaching empty condition, therefore enables optimum utilization of liner packages, and is a desired objective for design and implementation of such packaging. Upon completion of detection a second source of liquid is preferred to be automatically switched over, thereby eliminating any additional downstream operational concerns.

Another problem associated with packages from which liquids are dispensed for industrial processes such as manufacture microelectronic device products, relates to the fact that the liquids in many cases are extraordinarily expensive, as specialty chemical reagents. It therefore is necessary from an economic perspective to achieve as complete a utilization of the liquid from a package as possible, so that no substantial residual amount of liquid remains in the package after the dispensing operation has been completed. For such reason, it is desirable to monitor the dispensing operation in a manner that permits determination of the endpoint of such operation. There is a continuing effort in the art to provide efficient endpoint detectors that minimize the amount of liquid residuum in the package.

In prior art dispensing packages, diptubes have been employed, viz., tubes that extend downwardly in the interior volume of a container, and terminate slightly above the floor of the container. The use of diptubes in the dispense assembly contributes significantly to the volume of residual liquid in the package, due to material remaining in the diptube (for example, the hold-up volume of liquid in a diptube at the end of dispensing can be on the order of approximately 30 cc in a 19 liter bag-in-can (BIC) package, and slightly more in a 200 liter bag-in-can package).

The art therefore continues to seek improvements in dispensing packages and systems.

SUMMARY OF THE INVENTION

The present invention relates to dispensing systems, useful for supply of fluid materials to a tool, process or location at or in which the fluid is utilized, and to components and assemblies useful in such dispensing systems, and associated methodologies for making, using and commercializing such systems, components and assemblies.

In one aspect, the invention in one aspect relates to a fluid dispensing system comprising a pressure dispense package adapted to hold fluid for pressure dispensing, and a gas removal apparatus adapted to remove gas from the pressure dispense package before and during dispensing of the fluid.

In another aspect, the invention relates to a method comprising: (a) pressure dispensing fluid from the foregoing fluid dispensing system, (b) removing headspace gas from the at least one package prior to the pressure dispensing of fluid therefrom, and (c) removing ingress gas entering the liquid subsequent to removal of said headspace gas from the package, throughout the pressure dispensing. Such method may further include manufacture of a microelectronic device.

In another aspect, the invention relates to a connector adapted to mate with a pressure dispense package, the connector comprising a gas removal apparatus adapted to remove gas from the pressure dispense package before and during dispensing of a liquid therefrom, wherein the gas prior to removal thereof contacts the liquid. Such connector may optionally include: a main body portion defining a reservoir and including a probe that interfaces with the liner to provide a fluid-tight seal between the liner and probe, with the probe including a conduit extending upwardly into the reservoir and terminating at an upper end therein below an upper end of the reservoir, so that liquid flowing upwardly in the connector passes through the conduit and flows from the upper end thereof into the reservoir, for disengagement in the reservoir of gas from the liquid, to form a liquid level interface between the liquid and the gas in the reservoir; at least one sensor in sensor relationship with the reservoir; a liquid discharge valve; a gas discharge valve; and a valve controller operatively coupled with the at least one sensor and responsively arranged to control said gas discharge valve and liquid discharge valve so as to separate gas from liquid in said reservoir, and to separately discharge said gas and said liquid.

In another aspect, the invention relates to a liquid dispensing system comprising the foregoing connector coupled with a pressure dispense package. Such package may include a liner disposed within an overpack container.

In yet another aspect, the invention relates to a method comprising: (a) pressure dispensing fluid from at least one pressure dispense package through the foregoing connector, (b) removing headspace gas from the at least one package prior to the pressure dispensing of fluid therefrom, and (c) removing ingress gas entering the liquid subsequent to removal of said headspace gas from the package, throughout the pressure dispensing.

In another aspect, the invention relates to a method comprising: (a) pressure dispensing liquid from a pressure dispense package, (b) removing headspace gas from the package prior to the pressure dispensing of liquid therefrom to a fluid-utilizing application, and (c) removing unwanted gas entering the liquid subsequent to removal of said headspace gas from the package, throughout the pressure dispensing. Such method may include, for example, passing said liquid to a ventable gas/liquid separation zone or reservoir (e.g., in a connector coupled with said package); sensing presence or accumulation of gas in the gas/liquid separation zone or reservoir; and venting said gas from the gas/liquid separation zone or reservoir responsive to the sensing step. Such method may further include manufacture of a microelectronic device.

In another aspect, the foregoing aspects may be supplemented by automatic indication of "empty" conditions in a dispensing container with the use of a pressure transducer, or other inline or fixed pressure detection device, indicating container pressure/dispensed liquid pressure differential.

In another aspect, the foregoing aspects may be supplemented by "optimization" of pressure differential with the use of one or more pressure transducers, electronic and/or pneumatic valves, electronic pressure control devices, programmable logic controllers, flow meters, and/or indication devices to the process tool.

In a further aspect, the foregoing aspects may be supplemented by extracting headspace gas by use of a bubble indication or fluid indication device, such as a capacitive or ultrasonic sensor, used in conjunction with a pneumatic or electronic valve and a programmable logic control (PLC), microcontroller, or other electronic/pneumatic control device.

In another aspect, the foregoing aspects may be supplemented by a multi-package pressure dispense system, comprising a multiplicity of pressure-dispense packages, arranged for automatic 'A to B' switching.

In another aspect, any of the foregoing aspects may be combined for additional advantage.

Other aspects, features and embodiments of the invention will be more fully apparent from the ensuing disclosure and appended claims.

DETAILED DESCRIPTION OF THE INVENTION AND PREFERRED EMBODIMENTS THEREOF

Figure 1:
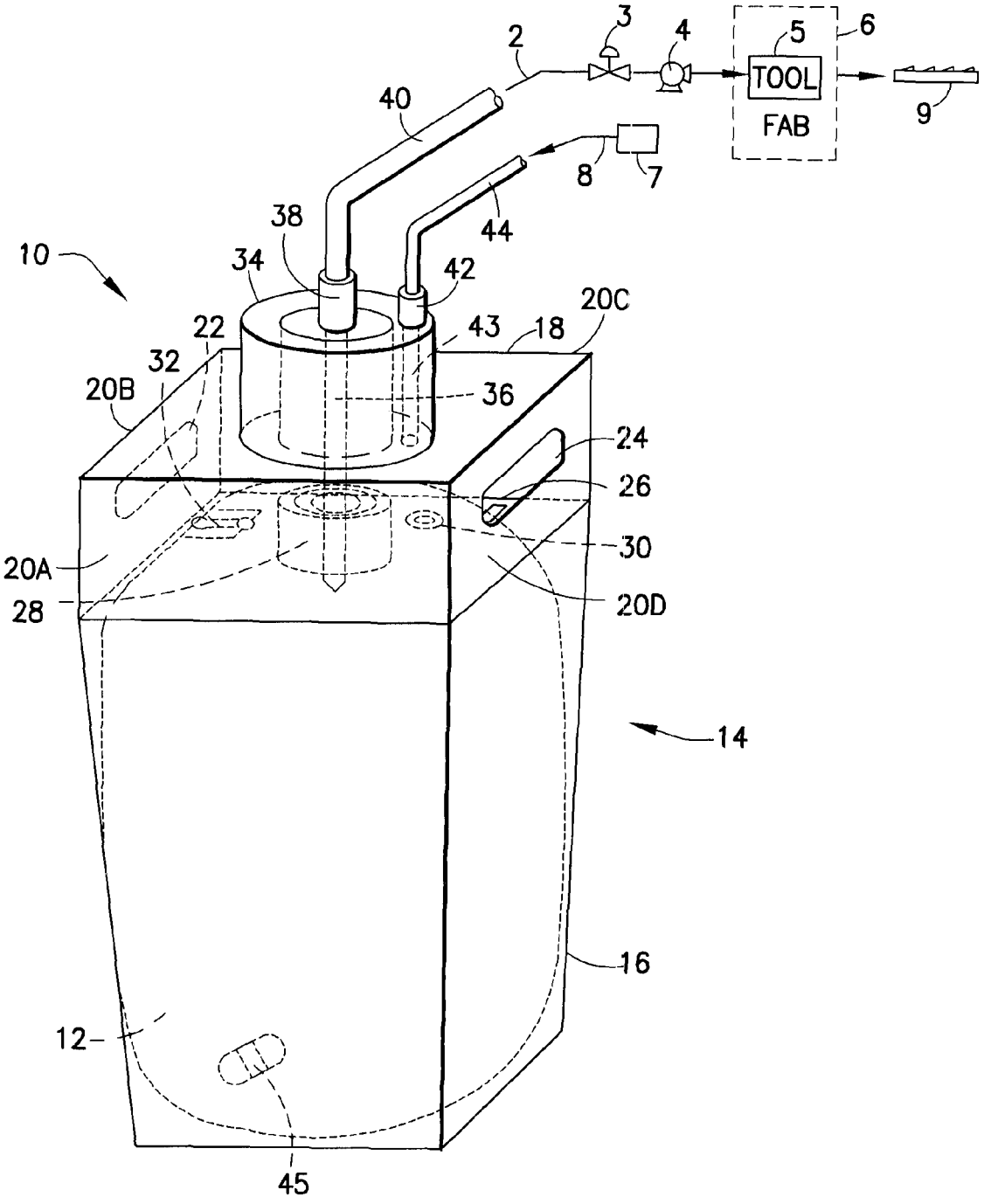
FIG. 1 is a schematic view of a process installation including a liner-based fluid storage and dispensing package arranged to provide a chemical reagent to a tool in a microelectronic product manufacturing facility, for the manufacture of a microelectronic product.

The present invention relates to dispensing systems for the supply of fluid materials, and to methods of fabrication and use of such systems. In a specific aspect, the invention relates to a liner-based liquid containment systems for storage and dispensing of chemical reagents and compositions, e.g., high purity liquid reagents and chemical mechanical polishing compositions used in the manufacture of microelectronic device products.

In the use of liner-based packages for storage and dispensing of fluid materials, wherein the liner is mounted in a rigid or semi-rigid outer vessel, the dispensing operation may involve the flow of a pressure-dispense gas into the vessel, exteriorly of the liner, so that the pressure exerted by the gas forces the liner to progressively be compacted so that the fluid material in the liner in turn is forced to flow out of the liner. The thus-dispensed fluid material may be flowed to piping, manifolding, through connectors, valves, etc. to a locus of use, e.g., a fluid-utilizing process tool.

Such liner-based liquid containment systems can be employed for storage and dispensing of chemical reagents and compositions of widely varied character. Although the invention is hereafter described primarily with reference to storage and dispensing of liquid or liquid-containing compositions for use in the manufacture of microelectronic device products, it will be appreciated that the utility of the invention is not thus limited, but rather the invention extends to and encompasses a wide variety of other applications and contained materials.

Although the invention is discussed hereinafter with reference to specific embodiments including various liner-based packages and containers, it will be appreciated that various of such embodiments, e.g., as directed to pressure-dispense arrangements or other features of the invention, may be practiced in liner-less package and container systems.

The term "microelectronic device" as used herein refers to resist-coated semiconductor substrates, flat-panel displays, thin-film recording heads, microelectromechanical systems (MEMS), and other advanced microelectronic components. The microelectronic device may include patterned and/or blanketed silicon wafers, flat-panel display substrates or polymer substrates. Further, the microelectronic device may include mesoporous or microporous inorganic solids.

In liner packaging of liquids and liquid-containing compositions (hereafter referred to as liquid media), it is desirable to minimize the headspace of the liquid medium in the liner. The headspace is the volume of gas overlying the liquid medium in the liner.

The liner-based liquid media containment systems of the present invention have particular utility in application to liquid media used in the manufacture of microelectronic device products. Additionally, such systems have utility in numerous other applications, including medical and pharmaceutical products, building and construction materials, food and beverage products, fossil fuels and oils, agriculture chemicals, etc., where liquid media or liquid materials require packaging.

As used herein, the term "zero headspace" in reference to fluid in a liner means that the liner is totally filled with liquid medium, and that there is no volume of gas overlying liquid medium in the liner.

Correspondingly, the term "near zero headspace" as used herein in reference to fluid in a liner means that the liner is substantially completely filled with liquid medium except for a very small volume of gas overlying liquid medium in the liner, e.g., the volume of gas is less than 5% of the total volume of fluid in the liner, preferably being less than 3% of the total volume of fluid, more preferably less than 2% of the total volume of fluid and most preferably, being less than 1% of the total volume of fluid (or, expressed another way, the volume of liquid in the liner is greater than 95% of the total volume of the liner, preferably being more than 97% of such total volume, more preferably more than 98% of such total volume, even more preferably more than 99% of such total volume, and most preferably more than 99.9% of such total volume).

The greater the volume of the headspace, the greater the likelihood that the overlying gas will become entrained and/or solubilized in the liquid medium, since the liquid medium will be subjected to sloshing, splashing and translation in the liner, as well as impact of the liner against the rigid surrounding container during transportation of the package. This circumstance will in turn result in the formation of bubbles (e.g., microbubbles) and particulates in the liquid medium, which degrade the liquid medium, and render it potentially unsuitable for its intended purpose. For this reason, headspace is desired to be minimized and preferably eliminated (i.e., in a zero or near-zero headspace conformation) with complete filling of the interior volume of the liner with liquid medium at the point of use. The package has to be shipped with some headspace gas in order to accommodate expansion of the contained material during shipment (as a result of temperature variation). Desirable systems according to the present invention therefore are arranged to remove the headspace gas at near atmospheric conditions after the package is coupled to a tool via dispensing flow circuitry. At atmospheric conditions, the gas is released from the chemical reagent and can easily be purged from the system before dispense of liquid to the tool.

The package includes a dispensing port that is in communication with the liner for dispensing of material therefrom. The dispensing port in turn is coupled with a suitable dispensing assembly. The dispensing assembly can take any of a variety of forms, e.g., an assembly including a probe or connector with a dip tube that contacts material in the liner and through which material is dispensed from the vessel.

The dispensing assembly in one embodiment is adapted for coupling with flow circuitry, e.g., flow circuitry of a microelectronic device manufacturing facility using a chemical reagent supplied in the liner of the package. The semiconductor manufacturing reagent may be a photoresist or other high-purity chemical reagent or specialty reagent.

The package can be a large-scale package, wherein the liner has a capacity in a range of from 1 to 2000 or more liters of material.

In a pressure-dispense mode, the liner-based package can be adapted for coupling with a pressurized gas source, such as a pump, compressor, a compressed gas tank, etc.

Referring now to the drawings, FIG. 1 is a schematic view of a process installation including a liner-based fluid storage and dispensing package arranged to provide a chemical reagent to a tool in a microelectronic product manufacturing facility, for the manufacture of a microelectronic product.

FIG. 1 shows a perspective view of an illustrative liner-based fluid storage and dispensing container 10 of a type useful in the broad practice of the present invention.

The container 10 includes a flexible, resilient liner 12 capable of holding liquid, e.g., a high purity liquid (having a purity of >99.99% by weight).

The liner 12 is desirably formed from tubular stock material. By the use of a tubular stock, e.g., a blown tubular polymeric film material, heat seals and welded seams along the sides of the liner are avoided. The absence of side welded seams is advantageous, since the liner is better able to withstand forces and pressures that tend to stress the liner and that not infrequently cause failure of seams in liners formed of flat panels that are superimposed and heat-sealed at their perimeter.

The liner 12 most preferably is a single-use, thin membrane liner, whereby it can be removed after each use (e.g., when the container is depleted of the liquid contained therein) and replaced with a new, pre-cleaned liner to enable the reuse of the overall container 10.

The liner 12 is preferably free of components such as plasticizers, antioxidants, uv stabilizers, fillers, etc. that may be or become a source of contaminants, e.g., by leaching into the liquid contained in the liner, or by decomposing to yield degradation products that have greater diffusivity in the liner and that migrate to the surface and solubilize or otherwise become contaminants of the liquid in the liner.

Preferably, a substantially pure film is utilized for the liner, such as virgin (additive-free) polyethylene film, virgin polytetrafluoroethylene (PTFE) film, or other suitable virgin polymeric material such as polyvinylalcohol, polypropylene, polyurethane, polyvinylidene chloride, polyvinylchloride, polyacetal, polystyrene, polyacrylonitrile, polybutylene, etc. More generally, the liner may be formed of laminates, co-extrusions, overmold extrusion, composites, copolymers and material blends, with or without metallization and foil.

The thickness of the liner material can be any suitable thickness, e.g., in a range from about 1 mils (0.001 inch) to about 30 mils (0.030 inch). In one embodiment, the liner has a thickness of 20 mils (0.020 inch).

The liner can be formed in any suitable manner, but preferably is manufactured using tubular blow molding of the liner with formation of an integral fill opening at an upper end of the vessel, which may, as shown in FIG. 1, be joined to a port or cap structure 28. The liner thus may have an opening for coupling of the liner to a suitable connector for fill or dispense operations involving respective introduction or discharge of fluid. The cap joined to the liner port may be manually removable and may be variously configured, as regards the specific structure of the liner port and cap. The cap also may be arranged to couple with a dip tube for introduction or dispensing of fluid.

The liner 12 preferably includes two ports in the top portion thereof, as shown in FIG. 1, although single port liners, or alternatively liners having more than two ports, can be usefully employed in the broad practice of the present invention. The liner is disposed in a substantially rigid housing or overpack 14, which can be of a generally rectangular parallelepiped shape as illustrated, including a lower receptacle portion 16 for containing the liner 12 therein, and optionally an upper stacking and transport handling section 18. The stacking and transport handling section 18 includes opposedly facing front and rear walls 20A and 20C, respectively, and opposedly facing side walls 20B and 20D. At least two of the opposedly facing side walls (shown in FIG. 1 as 20B and 20D) have respective manual handling openings 22 and 24, respectively, to enable the container to be manually grasped, and physically lifted or otherwise transported in use of the container. Alternatively, the overpack can be of a cylindrical form, or of any other suitable shape or conformation.

Preferably, the lower receptacle portion 16 of the housing 14 is as shown slightly tapered. All of the four walls of the lower receptacle portion 16 are downwardly inwardly tapered, to enable the stacking of the containers for storage and transport, when a multiplicity of such containers are stored and transported. In one embodiment, the lower portion 16 of housing 14 may have tapered walls whose taper angle is less than 15°, e.g., an angle between about 2° and 12°.

The generally rigid housing 14 also includes an overpack lid 26, which is leak-tightly joined to the walls of the housing 14, to bound an interior space in the housing 14 containing the liner 12, as shown.

In this embodiment, the liner has two rigid ports, including a main top port coupling to the cap 28 and arranged to accommodate passage therethrough of the dip tube 36 for dispensing of liquid. The dip tube 36 is part of the dispensing assembly including the dip tube, dispensing head 34, coupling 38 and liquid dispensing tube 40. The dispensing assembly also includes a gas fill tube 44 joined to dispensing head 34 by coupling 42 and communicating with a passage 43 in the dispensing head. Passage 43 in turn is adapted to be leak-tightly coupled to the interior volume port 30 in the overpack lid 26, to accommodate introduction of a gas for exerting pressure against liner 12 in the dispensing operation, so that liquid contained in liner 12 is forced from the liner through the interior passage of the hollow dip tube 36 and through the dispensing assembly to the liquid dispensing tube 40.

The gas fill tube 44 is joined to a gas feed line 8 coupled to a compressed gas source 7, e.g., a compressor, compressed gas tank, etc., for delivery of pressurizing gas into the interior volume of the overpack, and progressive compaction of the liner during the pressure dispense operation.

The liquid dispensing tube 40 is coupled with dispensed gas feed line 2 containing flow control valve 3 and pump 4 therein, to effect flow of the dispensed liquid from the package through such flow circuitry to the tool 5 ("TOOL") in the microelectronic product manufacturing facility 6 ("FAB"). The tool 5 can for example comprise a spin coater for applying photoresist to a wafer, with the dispensed liquid constituting a suitable photoresist material for such purpose. The tool alternatively can be of any suitable type, which is adapted for utilizing the specific dispensed chemical reagent.

Liquid chemical reagents can therefore be dispensed for use in the microelectronic product manufacturing facility 6, from liner-based package(s) of the illustrated type, to yield a microelectronic product 9, e.g., a flat panel display or a semiconductor wafer incorporating integrated circuitry.

The liner 12 advantageously is formed of a film material of appropriate thickness to be flexible and collapsible in character. In one embodiment, the liner is compressible such that its interior volume may be reduced to about 10% or less of the rated fill volume, i.e., the volume of liquid able to be contained in the liner when same is fully filled in the housing 14. In various embodiments, the interior volume of a liner may be compressible to about 0.25% or less of rated fill volume, e.g., less than 10 milliliters in a 4000 milliliter package, or about 0.05% or less (10 mL or less remaining in a 19 L package), or 0.005% or less (10 mL or less remaining in a 200 L package). Preferred liner materials are sufficiently pliable to allow for folding or compressing of the liner during shipment as a replacement unit. The liner preferably is of a composition and character that is resistant to particle and microbubble formation when liquid is contained in the liner, that is sufficient flexible to allow the liquid to expand and contract due to temperature and pressure changes and that is effective to maintain purity for the specific end use application in which the liquid is to be employed, e.g., in semiconductor manufacturing or other high purity-critical liquid supply application.

For semiconductor manufacturing applications, the liquid contained in the liner 12 of the container 10 should have less than 75 particles/milliliter of particles having a diameter of 0.25 microns, at the point of fill of the liner, and the liner should have less than 30 parts per billion total organic carbon (TOC) in the liquid, with less than 10 parts per trillion metal extractable levels per critical elements, such as calcium, cobalt, copper, chromium, iron, molybdenum, manganese, sodium, nickel, and tungsten, and with less than 150 parts per trillion iron and copper extractable levels per element for liner containment of hydrogen fluoride, hydrogen peroxide and ammonium hydroxide, consistent with the specifications set out in the Semiconductor Industry Association, International Technology Roadmap for Semiconductors (SIA, ITRS) 1999 Edition.

The liner 12 of FIG. 1 contains in its interior space a metal pellet 45, as illustrated, to aid in non-invasive magnetic stirring of the liquid contents, as an optional feature. The magnetic stirring pellet 45 may be of a conventional type as used in laboratory operations, and can be utilized with an appropriate magnetic field-exerting table, so that the container is able, when reposed on the table with the liner filled with liquid, to be stirred, to render the liquid homogeneous and resistant to settling. Such magnetic stirring capability may be employed to resolubilize components of the liquid subsequent to transit of the liquid under conditions promoting precipitation or phase separation of the liquid contents. The stirring element being remotely actuatable in such manner has the advantage that no invasive introduction of a mixer to the interior of the sealed liner is necessary.

The port 30 in deck 26 of the housing 14 can be coupled with a rigid port on the liner, so that the liner is fabricated with two ports, or alternatively the liner can be fabricated so that it is ventable using a single port configuration. In still another embodiment, a headspace gas removal port fitting surrounds the inner liquid dispense fitment without the use of an additional vent.

Deck 26 of the housing 14 may be formed of a same generally rigid material as the remaining structural components of the housing, such as polyethylene, polytetrafluoroethylene, polypropylene, polyurethane, polyvinylidene chloride, polyvinylchloride, polyacetal, polystyrene, polyacrylonitrile, and polybutylene.

As a further optional modification of the container 10, a radio frequency identification tag 32 may be provided on the liner, for the purpose of providing information relating to the contained liquid and/or its intended usage. The radio frequency identification tag can be arranged to provide information via a radio frequency transponder and receiver to a user or technician who can thereby ascertain the condition of the liquid in the container, its identity, source, age, intended use location and process, etc. In lieu of a radio frequency identification device, other information storage may be employed which is readable, and/or transmittable, by remote sensor, such as a hand-held scanner, computer equipped with a receiver, etc.

In the dispensing operation involving the container 10 shown in FIG. 1, air or other gas (nitrogen, argon, etc.) may be introduced into tube 44 and through port 30 of lid 26, to exert pressure on the exterior surface of the liner 12, causing it to contract and thereby forcing liquid through the dip tube 36 and dispensing assembly to the liquid dispensing tube 40.

Correspondingly, air may be displaced from the interior volume of housing 14 through port 30, for flow through the passage 43 in dispensing head 34 to tube 44 during the filling operation, so that air is displaced as the liner 12 expands during liquid filling thereof.

One aspect of the present invention relates to the ubiquitous problem of ensuring that the material contained in the container package is dispensable so that no or minimal residual of the material remains in the package after it has been used. In liner-based systems, it may be difficult to achieve this result. For example, in a 19 liter bag-in-can (BIC) supply package, up to 3 liters of material may remain in the liner when the associated empty detect process equipment indicates that the package is near empty. At such point, it is desirable to recover this remaining residual material from the container.

The corresponding system may for such purpose utilize a logic controller to control the flow of pressurizing gas, and a pressure transducer providing a device for empty detection, for system performance feedback. The pressure transducer may be adapted to monitor the pressure and to detect the onset of exhaustion of the vessel by sensing of a pressure droop accompanying such onset. The system is arranged to allow switching from an exhausted container to a fresh (full) container or a separate reservoir or hold-up tank, thereby providing for continuous operation, since the switchover to the second container or reservoir or hold-up tank permits switch-out of the exhausted first container with a fresh container, so that when the second container or reservoir or hold-up tank is exhausted, the replacement first vessel can resume supplying material for use.

One aspect of the invention contemplates headspace removal from the container so that the container has a zero or near-zero headspace. A connector of appropriate type is employed for coupling with the container to enable dispensing operation to be conducted. The flow circuitry coupled with the connector can be of any suitable type, including for example, solenoid valves, or high purity liquid manifold valves, as well as pressure regulators, e.g., of a current to pressure controlled type.

An operator interface may be employed in association with the supply package and the dispensing equipment, to monitor status of the material supply system and allow user input when necessary.

By using pressure droop as an indicator of empty status, it is possible to reduce residual material and achieve dispensing of over 99.92% of the material in the liner, in containers up to 200 liters in size. Further, by removing headspace from the material in the liner before dispensing is initiated, it is possible to avoid the use of a diptube for the dispensing operation. By elimination of the diptube, it is possible to dispense substantially all of the material from the liner.

The foregoing system in a preferred embodiment is adapted for switching from one container to another, so that the dispensing process continues, e.g., with flow of dispensed material to a downstream process tool, while one package is empty and the other is being changed out.

The foregoing system allows the headspace gas to be dispensed to a reservoir that is "on-line" (active in the dispensing flow circuitry) and dispensing to a downstream process tool, or other locus of use. The headspace gas can also be dumped to a drain or other disposition could be made of such gas. Each of the multiple containers can be arranged with a dedicated reservoir, so as to allow headspace gas removal, separate from the system.

The above-described system can be coupled to existing equipment to implement full control over chemical dispense by the downstream tool or other dispensed material-utilizing apparatus or process. The system can be arranged to supply dispensed material to the inlet valves of a reservoir, and be in a ready state when material is requested by the downstream process equipment.

Pressure sensing capability can also be implemented in the above-described system, and utilized to boost supply pressure of the dispensed material as necessary for improved utilization of the dispensed material.

Headspace removal can utilize a sensor that detects liquid media in a tube or in a reservoir. Components of the system described above can be used for stand-alone or retrofit systems, based on existing installation and facility requirements.

In connection with the preceding discussion of headspace removal in the use of the liner-based package, one aspect of the invention contemplates a mechanical headspace removal valve. Such mechanical headspace removal valve can be used in liner-based packages, e.g., of the bag-in-can (BIC), bag-in-drum (BID), or bag-in-bottle (BIB) type, in connection with empty detect, gas removal and/or A to B switching operations. The A to B switching operation refers to switching of one container (in that role, the "A" container) to a second container or a surge tank or hold-up reservoir for the dispensed material (in that role, the "B" container), to enable continuous dispensing operation. The number of containers can of course be increased beyond two in number, to allow A to B to C switching in the case of three containers, to allow A to B to C to D switching in the case of four containers, etc., and A to B switching is therefore used to denote continuous dispensing operation in multiple, sequentially switched, dispensing containers.

The invention in another aspect provides a flow restrictor vent valve for venting gas from liquid in the package, which can be a liner-based package or alternatively a liner-less package in which the material being supplied for dispensing is discharged from the package by displacement thereof from the interior volume of the package container.

The flow restrictor vent valve of the invention operates to eliminate any gas including headspace gas as well as microbubbles at the package container, eliminating such gases as soon as the package is pressurized. The flow restrictor vent valve functions automatically to remove gas from the package container of the dispensed material in any circumstance in which the container vessel is pressurized and gas is present in the contained material, including gas that permeates through the liner and diffuses into the contained material.

The flow restrictor vent valve of the invention is readily implemented with connectors of widely varied types, and does not require associated electronics and expensive componentry. The flow restrictor vent valve accommodates the variations in headspace volume of material-filled package containers, and variations incident to manufacturing of the package as well as variations in the dispensing operations in which the package may be deployed. The flow restrictor vent also eliminates the false closure of the valve due to high input pressure and low viscosity liquids.

FIGS. 2-5 illustrate a flow restrictor vent valve of the invention according to one illustrative embodiment thereof, with respect to its operation.

Figure 2:
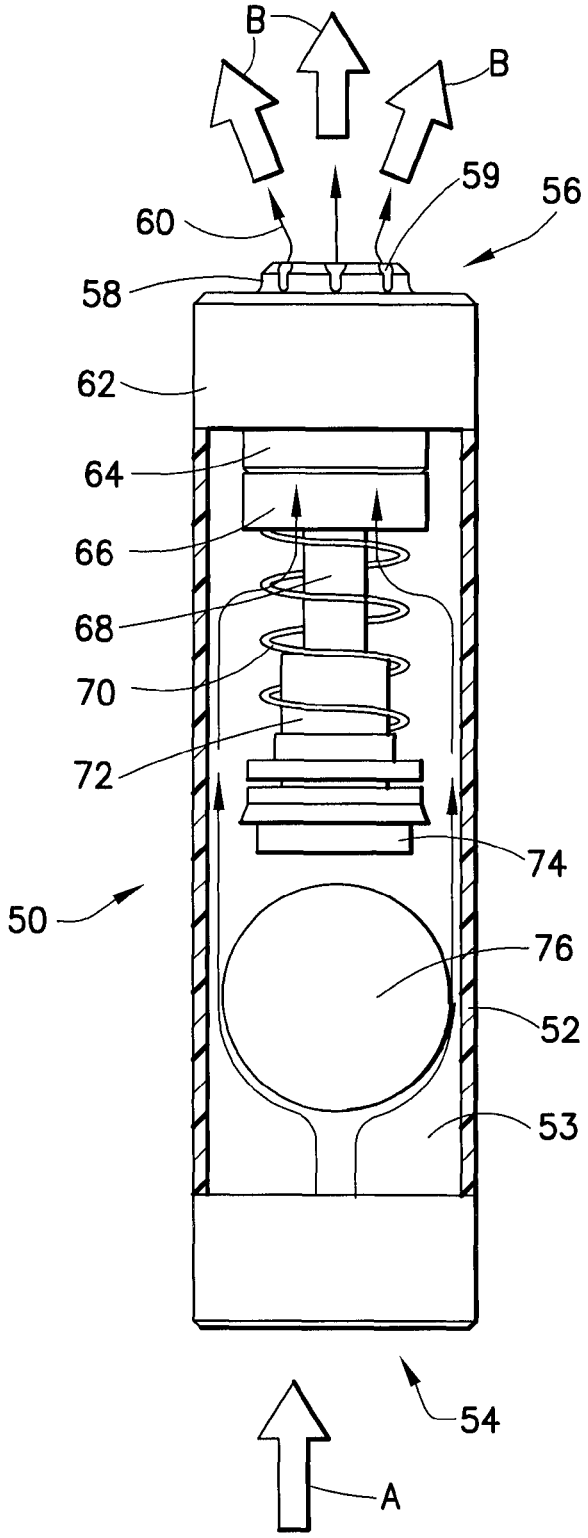
FIGS. 2-6 are various views of a flow restrictor vent valve assembly according to one embodiment of the invention, such as can be used in combination with a pressure dispense container such as a liner-based pressure dispense container.

As shown in FIG. 2, the flow restrictor vent valve 50 comprises a main body portion including an elongate housing defined by wall 52, which as illustrated can be of cylindrical form, enclosing an interior volume 53 as an elongate fluid flow path between the first open end 54 of the housing and the second, discharge end 56 of the housing. Disposed in the interior volume 53 is a float element 76, which can be solid, or partially or fully hollow, as desired, provided that it has a density (specific gravity) that is less than that of the liquid medium that is being stored or transported in, or dispensed from, a container that is desired to be degassed. This float element may be retained in the interior volume 53 of the flow restrictor vent valve housing by a screen, mesh or bar or other retention element (not shown) disposed at the open inlet end of the housing. The float element 76 can also vary in size and shape to accommodate spring force, headspace gas type and "liquid out" viscosity.

The flow restrictor vent valve at its discharge end 56 includes a cap 62 joined to the circumscribing wall 52. The cap 62 terminates at its upper end in a discharge nozzle 58 having channel openings 59 therein. The channel openings 59 are more clearly shown in FIG. 3, as communicating at a lower end of the cap with feed openings 82 and communicating at the upper end of the cap in the discharge nozzle 58, at discharge openings 80.

The channelized discharge nozzle 58 depends downwardly to a lower cylindrical portion 64 having joined thereto a circumscribing collar 66 defining an interior space in which a spring element 70 can be reposed in a compressed state, as discussed more fully hereinafter. The lower cylindrical portion 64 of the cap 62 also has centrally joined thereto a downwardly extending axle 68, about which the spring element 70 helically mounted. The axle is connected at a lower end thereof to a closure body 72 that includes an engagement ring 74 at its lower portion. The engagement ring 74 is matably engageable with the float element 76 when the latter is urged upwardly into contact with the engagement ring, as hereinafter more fully described.

To maintain valve closure through pressure changes, a magnetic insert (not shown) can be added to closure body 72 with the opposing magnet insert in the retainer. Encapsulated magnets could be used in place of all springs. This eliminates the potential for metals from the springs to contaminate the chemicals.

When the flow restrictor vent valve 50 is mounted on a container in fluid flow communication therewith, any pressurized gas will flow from the container into the flow restrictor vent valve through the open lower end 54, in the direction indicated by directional arrow A, and flow upwardly in the interior volume of the valve. Such gas will flow through the channels 59 in the channelized discharge nozzle 58 and egress as discharges 60 from the channel openings 80, flowing outwardly in the directions indicated by directional arrows B in FIG. 2.

During this period, the float element 76 may be suspended in the upflowing gas stream, as illustrated, or alternatively, depending on the volumetric flow through the flow restrictor vent valve, the float element may repose at the inlet of the valve, on retention structure of the above-described type (not shown). In any case, the float element is not in contact with the engagement ring 74 and accommodates the flow-through of the pressurized gas, with the gas stream flowing around the float element.

By this operation, the pressurized gas in the associated container, such as in a liner retained in a rigid overpack, is vented through the discharge nozzle, and egresses from the package. By such operation, headspace gases can be readily removed from a liner, such as during initial pressurization involving the external imposition of gas pressure on the exterior surface of the liner.

Figure 4:
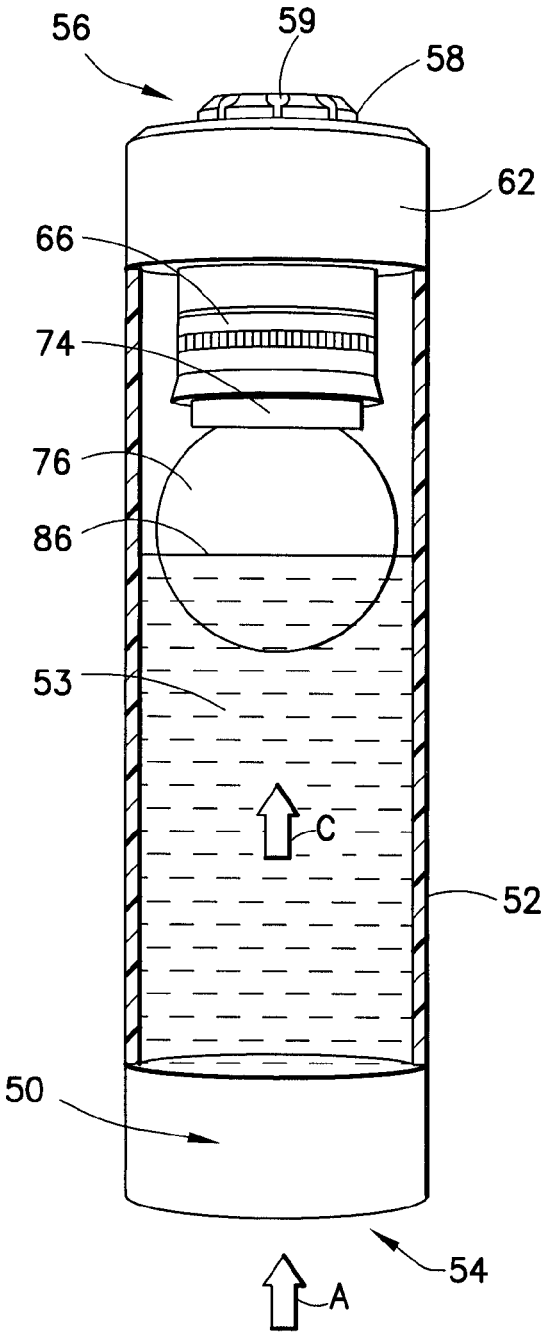
Figure 5:
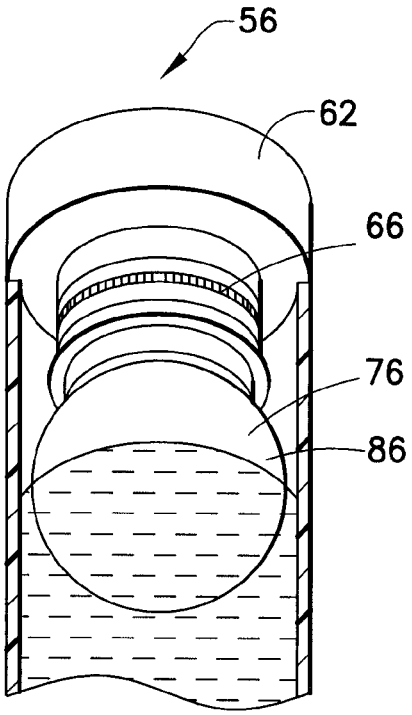

FIGS. 4 and 5 show a subsequent stage of operation of the flow restrictor vent valve 50, in which the pressurized gas has been removed from the associated container on which the valve is mounted, wherein liquid from the container is flowing into the interior volume 53 of the housing bounded by wall 52, flowing into the inlet of the housing through open end 54, in the direction indicated by arrow A, and flowing upwardly in the direction indicated by arrow C in the interior volume.

The upflow of liquid carries the float element 76 upwardly, with the float element floating on the surface of the liquid (liquid-gas interface 86 being indicated in FIGS. 4 and 5), so that the float element engages the engagement ring 74 and exerts an upward force on the closure body 72 so that the spring element 70 compresses and is compressively forced into the space bounded by collar 66. In this position, the closure body 72 closes the channels 59 to flow, so that no fluid flow can pass through such channels to channel openings 80. Thus, the float pressure exerted by the float element overcomes the spring force of the spring element to close the valve.

Figure 6:
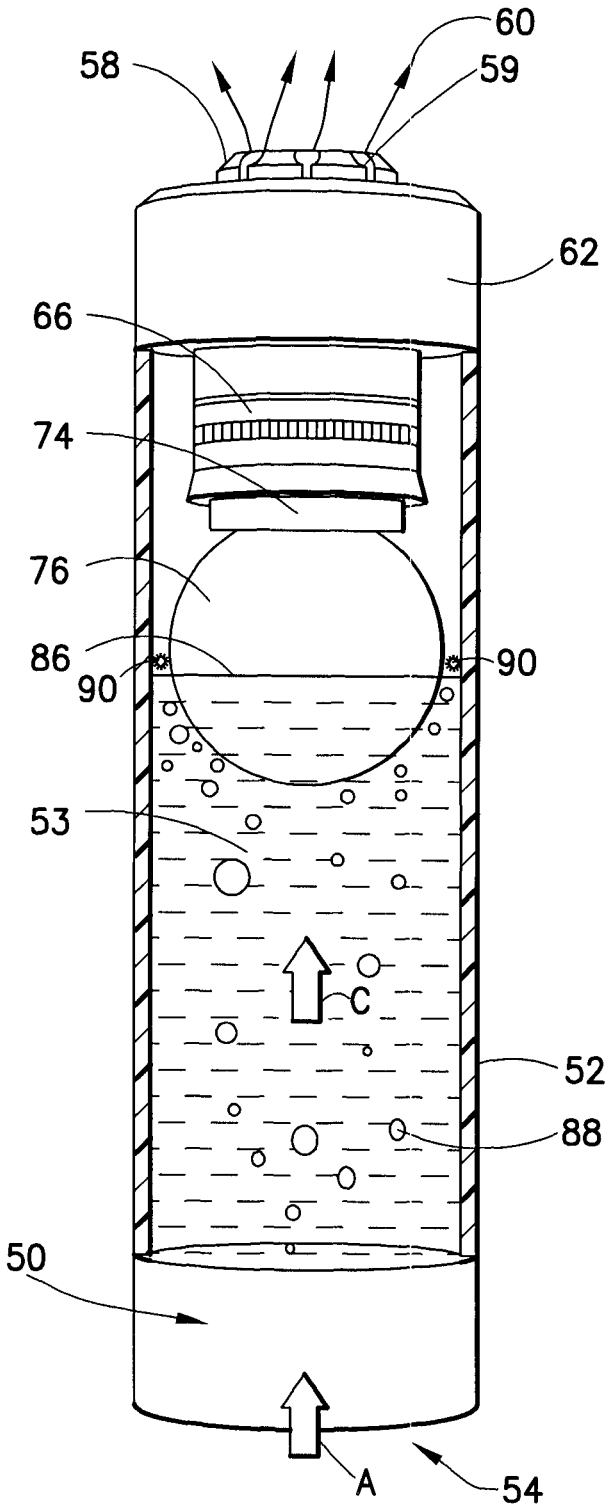

The subsequent stage of operation is shown in FIG. 6 in which the bubbles and microbubbles 88 in the liquid in the container joined to the flow restrictor vent valve rise in the direction indicated by arrow C, into the housing of the valve. As they continue rising in the housing of the valve, the microbubbles and bubbles enter the upper gas space in the interior volume 53 where they pop at the gas-liquid interface 86, as shown by the popping microbubbles/bubbles 90 at such interface in FIG. 6.

The ingress of gas from the popping bubbles and microbubbles into the gas space overlying the gas-liquid interface in the housing of the valve then causes the gas-liquid interface to progressively drop, until a point is reached, at which the float element 76 disengages from the engagement ring 74 of the closure body, thereby causing the closure body to be urged downwardly by the spring element to open the channels 59 to flow of the accumulated gas. The accumulated gas then flows through the channels 59 and is discharged at the upper end of the cap through the channel openings 80.

In this manner, accumulations of headspace gas and bubbles/microbubbles in the liquid in the container are vented efficiently through the flow restrictor vent valve, to prevent accumulations of bubbles and microbubbles in the contained liquid, and to quickly vent the headspace gas in initial pressurization for pressure-dispensing of the liquid.

It will be appreciated that the inlet length of the flow restrictor vent valve can be varied as to its length and diameter, to accommodate specific gas and liquid flows (flow rates, and duration of flows). As a further optional modification, a one-way valve element can be added at the inlet of the flow restrictor vent valve assembly, to obviate any issues relating to the return of liquid into the container to which the flow restrictor vent valve assembly is coupled.

As another modification that optionally can be made to the flow restrictor vent valve assembly, filter element(s) can be provided at the channel openings 80, or in the channels 59, to allow air passage while retaining liquid from flowing out of the valve assembly. The filter can be of any suitable material of construction, such as Gore-Tex® fabric or other air-breathable or gas-permeable material.

The valve assembly and components can be formed of any suitable materials of construction, including Teflon® or FEP or other polymeric or non-polymeric material(s) accommodating the requirements of the liquid and gases to be vented. The float element as a float can be shaped in any suitable manner to minimize its travel in an air or other gas stream, while maximizing its lift (buoyancy) characteristics in rising liquid in the housing.

The flow restrictor vent valve assembly optionally can incorporate other actuatable openable/closeable elements in addition to the structure illustratively shown, to further enhance the leak-tightness of the assembly, so that liquid is prevented from egress from the assembly under widely varied process conditions.

In one embodiment not necessarily tied to the foregoing flow restrictor vent valve assembly, a pressure dispense system includes a package adapted to hold a fluid (e.g., within a collapsible liner), with the system including a filter downstream of the package to filter fluid delivered from the package (e.g., from the liner). The filter may be positioned, for example, in flow circuitry and/or in a connector coupleable to the package. The filter is preferably disposed upstream of a reservoir in which gas-liquid separation is effected, such as between a pressure dispense package and such a reservoir. The filter is preferably removable and replaceable, such as with a dedicated fitting or housing adapted to receive a replacement filter element. Such filter may function to capture any gross particles that may interfere with or clog small orifices of components (e.g., valves) of a gas removal apparatus or other fluid flow regulation device. Alternatively, or additionally, the filter may be selected and positioned to restrict the passage of bubbles into such a reservoir and/or dispense terrain. The filter may include, for example, any of a mesh, packed or porous media, a membrane, and a spunbonded material. Filtering operations may be conducted continuously, or performed intermittently—e.g., automatically or at the initiation of a user—and may be controlled by a controller such as a programmable logic controller.

In another embodiment, a fluid dispensing system, including at least one pressure dispense package and a gas removal apparatus as described herein, is in at least intermittent fluid communication with a source of cleaning fluid, with the system preferably further comprising a controller adapted to initiate a cleaning operation utilizing said cleaning fluid for cleaning at least a portion of said gas removal apparatus. Cleaning operation may also be manually initiated. Cleaning fluid may be used, for example, to clean various conduits, connectors, flow circuits, sensors, and flow control elements of dispensing system and/or gas removal apparatus as described herein. Valves may be operated to isolate any of primary gas inlet, liquid outlet, and gas outlet elements to facilitate such cleaning operation. Such cleaning operations may be automatically conducted on a given schedule, based on feedback from any of various sensing elements indicating that cleaning is required, or at the initiation of a user. Cleaning operations may be further controlled by a controller such as a programmable logic controller.

Another aspect of the invention relates to an end point monitor for pressure dispense operation, which is simple and economic in character.

Figure 7:
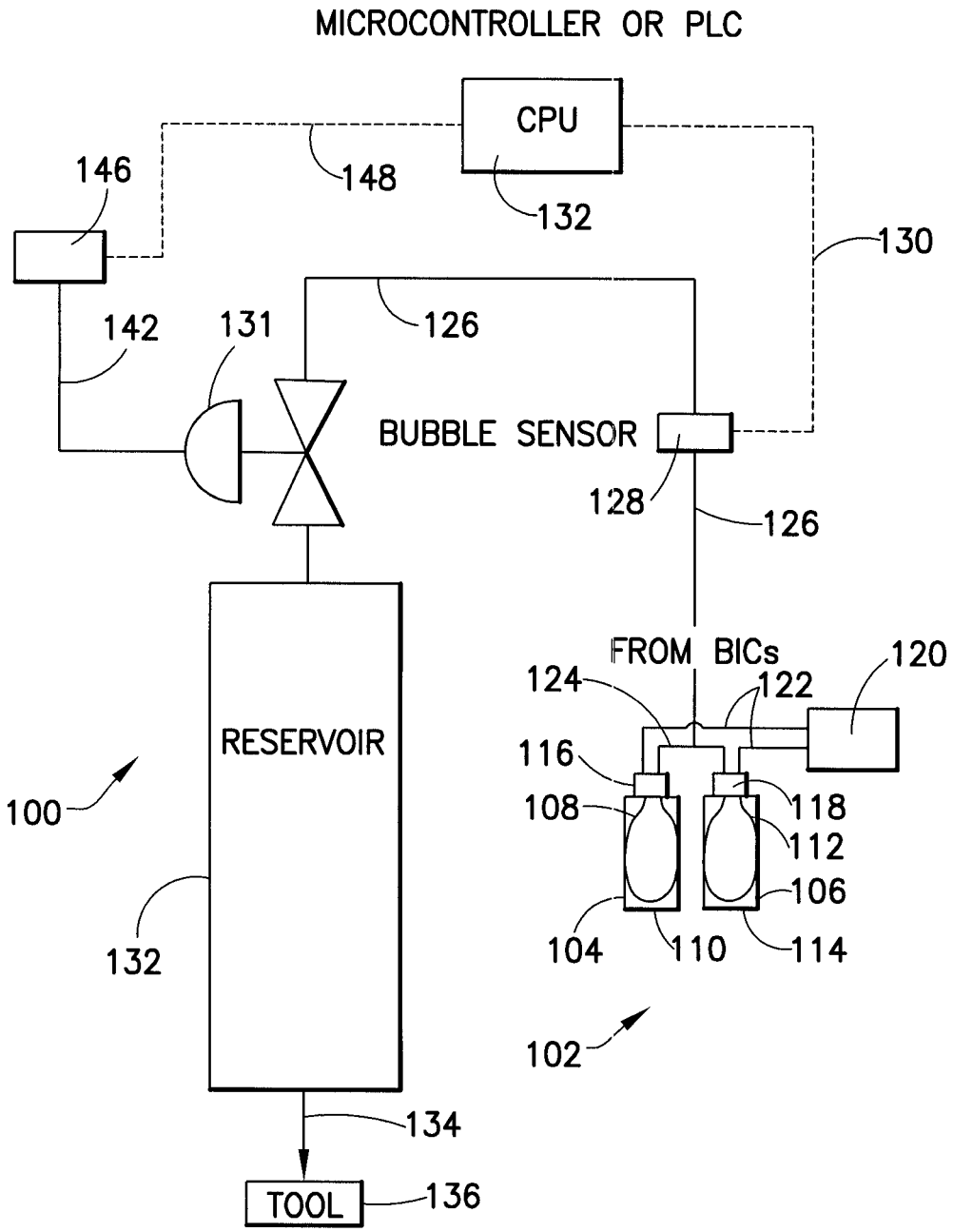
FIG. 7 is a schematic representation of a pressure dispense system according to another embodiment of the invention, utilizing a bubble sensor end point detector.

FIG. 7 is a schematic representation of a fluid dispensing system 100 including an assembly 102 of liner-based packages 104 and 106. Package 104 includes a liner 108 in a rigid overpack 110, coupled with a connector 116 joined by pressurizing gas feed line 123 to the pressurizing gas source 120. In like manner, package 106 includes a liner 112 in a rigid overpack 114, coupled with connector 118 joined by pressurizing gas feed line 122 to the pressurizing gas source 120. The connectors 116 and 118 are coupled with liquid discharge lines that join a manifold 124 of the flow circuitry. A liquid feed line 126 is joined in liquid flow communication with a reservoir tank 132, from which liquid is flowed in introduction line 134 to a semiconductor manufacturing tool 136 or other liquid-utilizing facility or process.

Disposed in the liquid feed line 126 is a bubble sensor 128 to determine the presence of bubbles in the liquid deriving from packages 104 and 106. The bubble sensor upon detection of bubbles in the liquid stream responsively generates an output signal that is transmitted in signal transmission line 130 to the CPU 132, which may comprise a microcontroller, programmable logic controller, dedicated general purpose programmable computer, or other control module. The liquid feed line 126 also contains a pneumatic valve 131 joined by pneumatic line 142 to the pressure switch 146. The pressure switch 146 is connected to the CPU 132 by signal transmission line 148.

In another embodiment a particle count detection device can also provided on the connector or on the "fluid out" line, to indicate purity of the dispensed material being flowed to the downstream operation.

In operation of the system shown in FIG. 7, the change in state of the bubble sensor 128 sensing is measured when the pneumatic valve 131 is tripped. When the pneumatic valve 131 is actuated, the system should be flowing liquid from the source packages through liquid feed line 126. At the start of the dispense operation, incidental bubbles may pass through the sensor. These can be ignored by appropriate setting of the CPU sensing parameters. For the majority of the subsequent dispensing operation, no bubbles will be detected. Near the end of the dispense operation, as the on-stream source package approaches exhaustion (the source packages being adapted by appropriate valving, and controls (not shown in FIG. 7) for A to B switching of the packages), bubbles will be forced through the liquid feed line 126, sensed by the bubble sensor 128, and a flag responsively will be set at such point by the CPU 132. At the end of dispense operation, as the on-stream package is exhausted of liquid, the bubble sensor will be in one of two states. The system may stall with gas in the line 126 or alternatively it may stall with liquid in the line 126, but the frequency of state change will approach and go to zero. When this behavior is detected by the CPU 132, the on-stream package is empty, and A to B switching of the on-stream vessel to the other fresh vessel may be effected by appropriate manipulation of the valves and flow controls associated with the source packages in the manifolded array.

Figure 8:
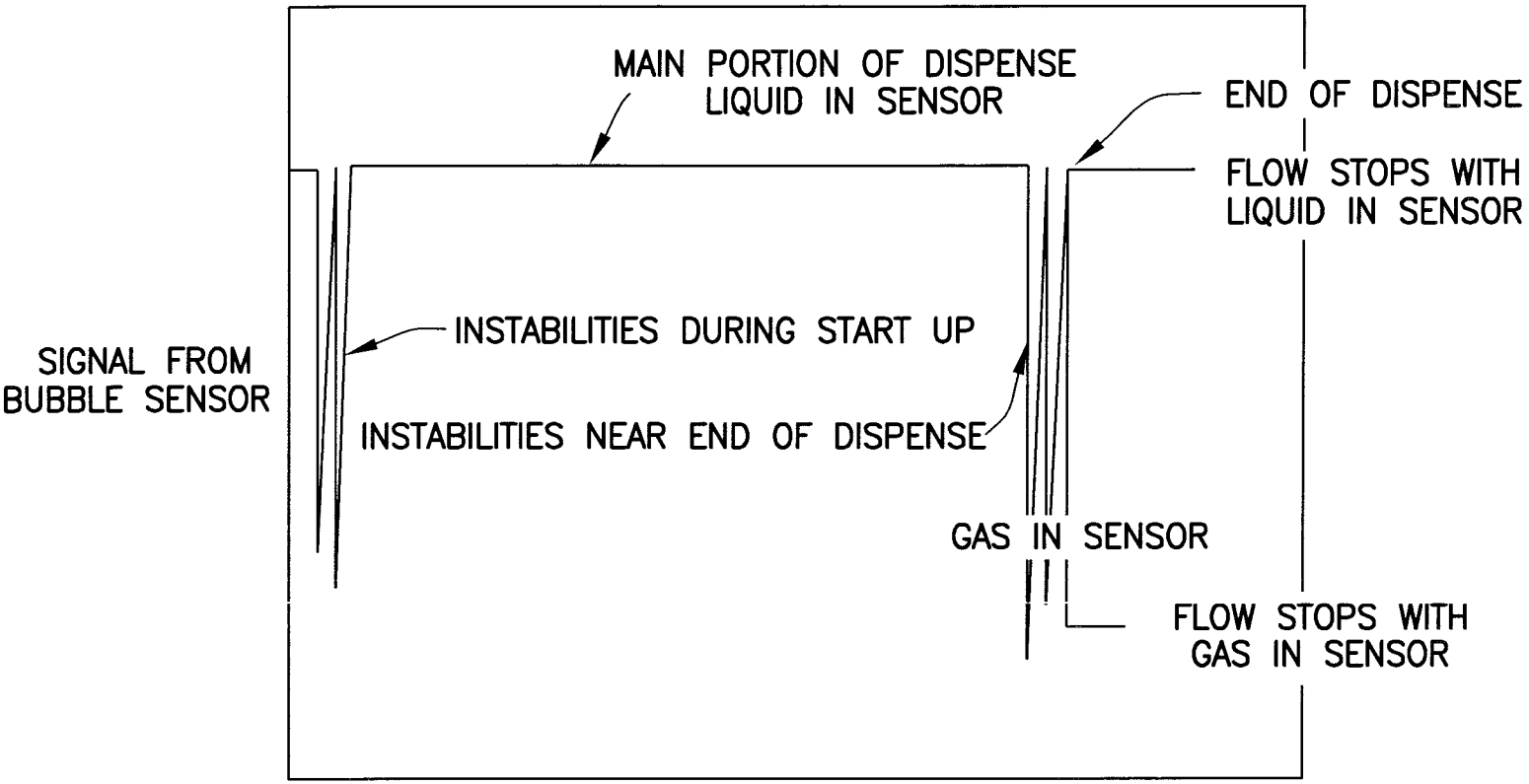
FIG. 8 is a trace of the bubble sensor signal as a function of time, for a bubble sensor end point detector of the type shown in the FIG. 7 system.

FIG. 8 is a graph of the signal from the bubble sensor 128 to the CPU 132 as a function of time, during the dispense operation of the system shown in FIG. 7. As illustrated, the signal trace shows instabilities during startup, followed by a liner continuity of the signal during the main portion of dispensing, with liquid in the sensor. Near the end of the dispense operation, instabilities appear in the trace, with extrema reflecting flow stoppage with gas in the sensor and flow stoppage with liquid in the sensor, as illustrated, with the frequency of the state change going to zero at the end of dispense.

Another aspect of the invention relates to a method of recovering additional residual material from a package after it has completed dispensing service. When packages have been exhausted as a result of dispensing, residual chemical reagent can be recovered by providing a fresh (filled with liquid) container that serves as a capture container, having a headspace therein that will accommodate the filling of the capture container with the residue of unused liquid from the exhausted container. The capture container then is arranged for vented filling, so that the headspace gas can be displaced from the fresh container by added liquid from the exhausted container, and the fresh container thereupon is coupled by a transfer line with the exhausted container, following which sufficient pressure is applied to interior volume of the exhausted container to effect flow of residual liquid therefrom into the capture container.

By such method, it is possible to capture the residual liquid in the exhausted container and to reduce the amount of final material in the exhausted container to less than 0.1 percent by weight, based on the total weight of liquid initially charged to the container.

Liner-based pressure dispense packages of the invention can be utilized in accordance with the dimension in a fully automated A to B switching liquid supply system, to provide continuity of dispensed liquid flow to a tool, or other end use apparatus, process or location.

Figure 9:
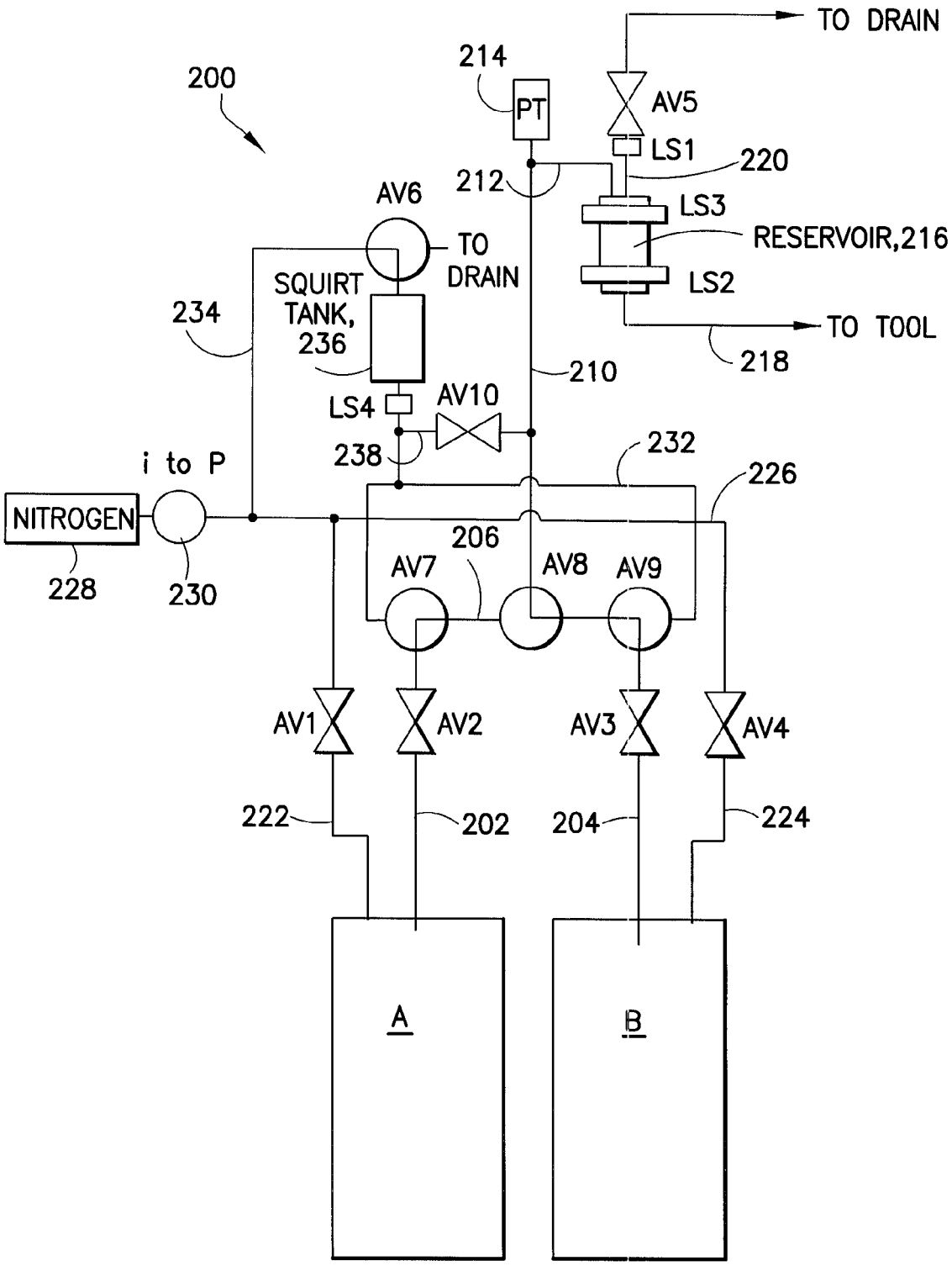
FIG. 9 is a schematic representation of an automatic A package to B package pressure dispense switching system for delivery of chemical reagent to a downstream tool, or other apparatus, process or location.

An illustrative system 200 is shown in FIG. 9, and includes two pressure dispense packages A and B. Package A has a dispense line 202 coupled therewith, containing a flow control valve AV2 therein. Package B likewise has a dispense line 204 coupled therewith, containing flow control valve AV3 therein. Dispense lines 202 and 204 are coupled to manifold 206 comprising the three-way valves AV7, AV9 and AVB, as illustrated. The manifold 206 in turn is joined via the three-way valve AV9 with the discharge line 210 containing pressure transducer 214 at its terminus. Branch line 212 interconnects the discharge line 210 with the reservoir 216.

The reservoir at one end is coupled with a source line 218 for delivery of dispensed reagent to a downstream tool or other apparatus, process or location. The reservoir at its other end is coupled with drain line 220 containing valve AV5 therein. Liquid level sensors LS2 and LS3 are associated with the reservoir and liquid level sensor LS1 is contained in the drain line 220, downstream from the reservoir.

The manifold 206 is coupled with a secondary manifold 232 joined in turn to a bypass line 234 coupled with the pressurizing gas feed line 226. The pressurizing gas feed line 226 is coupled with package pressure line 222 having valve AV1 therein for introducing pressurizing gas into package A, and line 226 is coupled with package pressure line 224 having valve AV4 therein for introducing pressurizing gas into package B.

The pressurizing gas feed line 226 is coupled with a source 228 of nitrogen or other pressurizing gas, and line 226 contains an i to P regulator. The bypass line 234 contains a drain valve AV6 and a squirt tank 236, and liquid level sensor LS4. A connector line 238 extends between the bypass line 234 and the discharge line 210, and contains valve AV10.

The conductance of valve AV5 is low, since bleeding of the system will be carried out and the valve AV5 serves to minimize fluctuations in system pressure. The system requires a PLC or microprocessor controller to measure level sensors, control valves, and to drive the i to P pressure regulator 230. The system schematically shown in FIG. 9 can be implemented with a valve block manifold, as would be desirable from the perspective of robustness, cost and footprint and volume of the system.

In operation, the system will be described as delivering initially from the "A" side. Pressure to the annular space of the on-stream dispensing vessel is provided by the i to P pressure regulator and valve AV1. Liquid moves through valves AV2, AV7[R], AV8[L], reservoir 216 and to the tool in line 218. Valves AV3, AV4, AV5, and AV10 are off. Container "B" is not yet connected.

During the dispensing of liquid from the "A" container, the "B" container is attached to the system, preferably soon after the start of dispensing of liquid from container "A." The annular space of container "B" is pressurized by opening valve AV4. After sufficient time, valve AV3 is opened, and valves AV8[L] and AV9[R] are turned. Headspace gas will then move from container "B" to the reservoir, with system liquid level sensors LS1, LS2 and LS3 being active. The system then modulates valve AV5 to vent the reservoir and maintain the liquid levels within the detection range of LS1 and LS3. This is done with little or no disruption of flow or pressure to the tool.

After the headspace of container "B" is drained, valves AV3 and AV4 are closed and valve AV9[L] is turned, while dispensing of liquid from container "A" is continued. The pressure of the delivery system is measured by the pressure transducer 214. This pressure is used as an input to boost the pressure of the i to P pressure regulator. When the pressure of the i to P pressure regulator reaches a critical point indicating a small amount of liquid is left in container "A," the system initiates dispensing of liquid from container "B."

To use the remaining liquid in container "A," pressure from the i to P regulator is applied to the annular space of container "A" through valve AV1. Liquid is allowed to flow through valves AV2 and AV7[L] into the squirt tank, with AV6 open to the drain, and valve AV10 closed.

After a predetermined short period of time, all of the liquid from container "A" will be moved to the squirt tank 236. Valves AV1, AV2 and AV3 are closed. Valve AV6 is turned to the nitrogen source and valve AV10 is opened. This state of the system allows the liquid from the squirt tank to feed the system. When gas begins to fill the reservoir as the liquid is exhausted from the squirt tank, as sensed by LS3 (liquid to gas sense), valve AV10 is closed and valve AV3 is opened. The gas in the reservoir can be extracted by opening valve AV5 until liquid is sensed by LS1.

The above-described process then is reversed with respect to the container "A" side of the system, when container "B" is the dispensing container.

Figure 10:
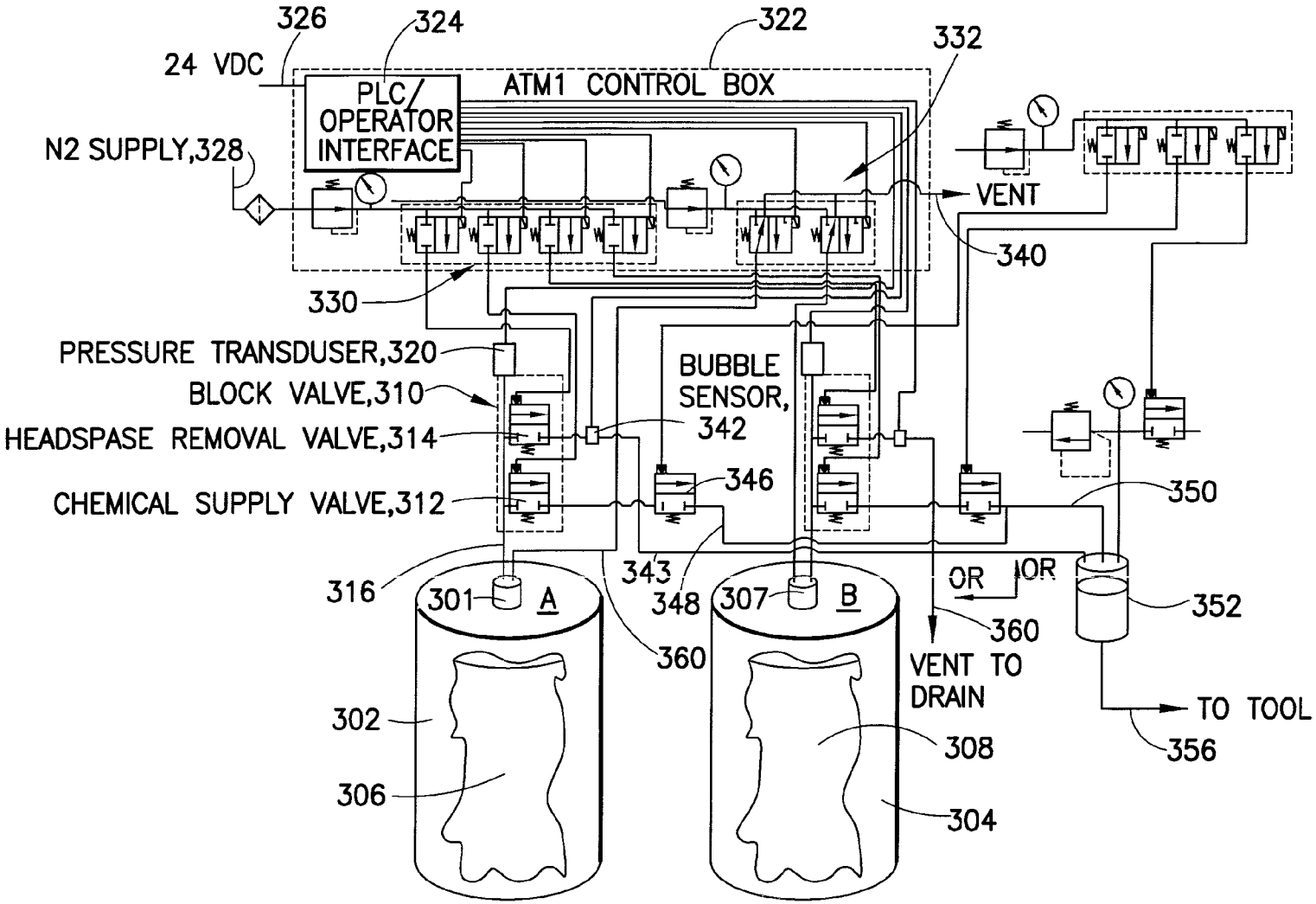
FIG. 10 is a schematic representation of a dispensing system according to another embodiment of the invention, constituting an A to B system that incorporates fully automatic headspace removal, empty detection and switching from package A to package B upon empty detection, wherein the system incorporates a "no dip tube" design in which the dispense probe is very short and only protrudes into the liner enough to seal against the fitment of the liner.

FIG. 10 is a schematic representation of a dispensing system according to another embodiment of the invention including another "A" and "B" container system that is adapted for switching at the point of exhaustion of a first one of such containers, from the exhausted one of the containers to a fresh one of the containers.

The "A" vessel in the system includes a rigid overpack 302 in which is disposed a liner 306 formed of a polymeric material laminate, holding a chemical reagent for dispensing. The "A" vessel has a connector 301 to which is joined a liquid dispensing line 316 connected with chemical supply valve 312 and headspace removal valve 314 mounted in block valve 310. The liquid dispensing line 316 downstream of the block valve 310 is connected to a pressure transducer 320 for pressure monitoring of the dispensing line.

The interior volume of the "A" container receives pressurizing gas via pressurizing line 360 fed with gas deriving from a nitrogen gas source ("N2 supply") coupled to N2 discharge line 328 joined with an array 330 of valves in the control box 322, and communicating with the vent line 340 coupled with the vent valve array 332.

The control box 322 includes a programmable logic controller (PLC)/operator interface 324 for the system, arranged as illustrated. The control box is also joined to a 24 volt DC cable 326 for powering the box and the componentry associated therewith.

The chemical supply valve 312 operates to discharge the dispensed chemical reagent from the liquid dispensing line 312 through valve 346 for flow into the reservoir 352. From the reservoir 352, the liquid is flowed in line 356 to the dispensing tool or other liquid-utilizing process or apparatus. The headspace removal valve 314 in liquid dispensing line 316 discharges headspace gas into the headspace removal line 343 containing bubble sensor 342. From the headspace removal line 343 the headspace gas is flowed into the reservoir 352 or into a drain by drain line 360.

The "B" container is similarly constructed in relation to the "A" container, and features rigid overpack 304 communicating at its upper end with connector 307 in turn joined to the flow circuitry in a manner similar to that of connector 301 of the "A" container.

The on-stream container in the FIG. 10 system is substantially completely emptied by application of pressure to the annular space of the container. Such application of pressure to the liner is carried out so as to achieve a predetermined level of remaining liquid in the liner, e.g., less than 15 cc's in a specific embodiment. The system shown in FIG. 10 is of a general type that can be variously configured, in specific embodiments, with any or all, or combinations, of the following features: (1) a logic controller, (2) a pressure transducer, for empty detection monitoring and/or system performance monitoring, (3) A to B switching, wherein B can be another container or a separate reservoir, (4) headspace removal from the container, (5) a new connector system, (6) solenoid valves, as high purity liquid manifold valves, (7) pressure regulators, such as i to P pressure regulators, (8) operator interfaces to monitor status and allow for user input as needed, (9) liner-based container systems, and (10) pressure differential monitoring of supply pressure versus outlet pressure, so that as the outlet pressure droops, inlet pressure can be boosted by using an i to P controller to keep the outlet pressure steady as the container nears an empty state.

This system allows for dispensing headspace gas to a reservoir that is online and dispensing to a tool, as shown in the embodiment of FIG. 10. The headspace gas can also be dumped to a drain if it is preferred to remove headspace in this manner. Each container in the system could be arranged with its own reservoir to allow for headspace removal separate from the system.

Such system in another embodiment can optionally employ mechanically- and/or electronically-assisted headspace removal. In a mechanical removal, the headspace gas would be automatically dumped through a fitting until liquid closes the valve automatically. Any accumulating air and bubbles would also automatically rise to the highest point in the valve and release gas. This manual headspace removal valve could be located directly on or within the BIC connector.

The foregoing system can be coupled to existing equipment to implement full control over chemical dispense by the tool. The system would supply chemical to the inlet valves of the reservoir and be in a ready state for supply of chemical when needed by the tool. Pressure sensing capability can also be utilized to boost the supply pressure as necessary for better utilization of the chemical.

Figure 11:
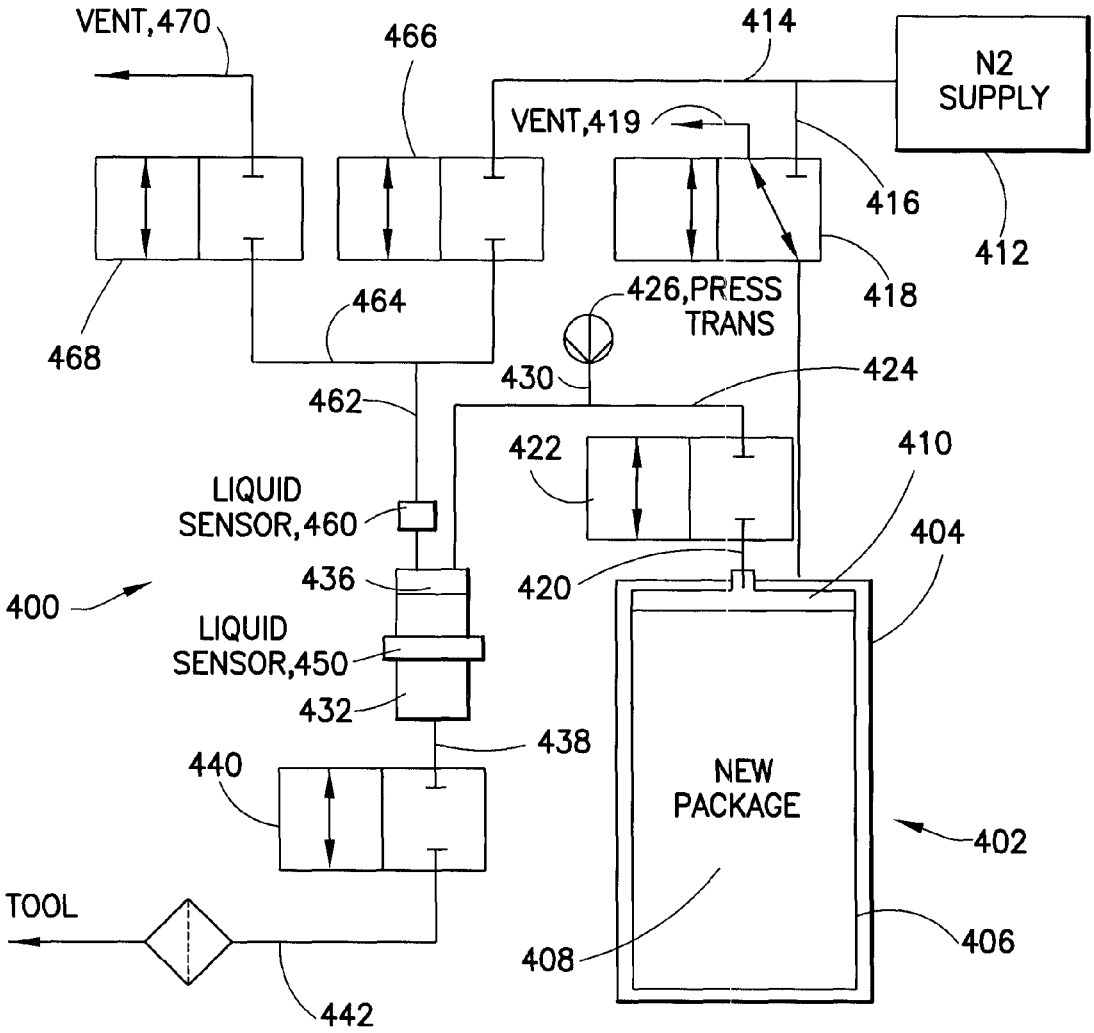
FIG. 11 is a schematic representation of a dispensing system according to another embodiment of the invention, incorporating a reservoir adapted to remove headspace gas through the "liquid out" line.

Separate componentry can be used on other systems that can use a reservoir instead of another container as the "B" part of an A to B switching scenario. The user can switch out the "A" container while dispensing from a reservoir as shown in FIG. 11 discussed hereinafter. Pressure monitoring is the main tool for system control, and headspace removal can utilize a sensor that detects liquid media in a tube or as part of a reservoir.

Parts of the system can be used for stand-alone or retrofit systems, based on system requirements.

FIG. 11 is a schematic representation of a dispensing system 400 according to another embodiment of the invention.

In this system, the dispense package 402 includes a rigid or semi-rigid overpack 404, having liner 408 mounted therein. Nitrogen or other pressure dispense gas is supplied by a gas supply 412. From the gas supply 412, the pressure dispense gas is flowed from the main flow line 414 through branch feed line 416 containing valve 418 therein, into the annular space 406 between the liner and the overpack.

During dispensing, the pressurizing gas is introduced to the annular space at sufficient flow rate and pressure to effect progressive compaction of the liner for dispensing of liquid through the dispense line 424. The dispense line 424 contains valve 422. Pressure transducer 426 is coupled with the dispense line by pressure sensing conduit 430. The dispense line 424 also is coupled with a reservoir 432 having headspace 436 therein and equipped with a liquid sensor 450.

The reservoir 432 is joined to a delivery conduit 442, having flow control valve 440 therein, to flow the dispensed liquid to a downstream tool, such as a semiconductor manufacturing tool, or other apparatus, process or location. The headspace of the reservoir 432 is coupled to a gas discharge line 462 having liquid sensor 460 therein. The gas discharge line 462 is joined to a gas vent line 464, such line constituting a manifold with opposite ends connected to valves 466 and 468. Valve 468 is coupled to vent line 470, for discharge of the headspace gas and extracted bubbles and microbubbles from the system.

The main flow line 414 from the nitrogen source 412 is coupled to valve 466 for bypass flow through the gas vent line 464 and vent line 470. The valve 418 is coupled with a vent line 419 for venting of the headspace gas from the package 402.

By the arrangement shown in FIG. 11, the headspace 410 in the liner 408 is vented through the reservoir 432, and ultimately discharged from the system in vent line 470. The reservoir 432 is monitored by liquid sensors 450 and 460, and functions to provide a hold-up supply of liquid to the downstream process tool or other fluid destination of the dispensed liquid. The liquid sensors function to provide endpoint determination capability, as the liquid is exhausted from the package 402.

The system shown in FIG. 11 can be automated with an automatic control system linked to the various valves, pressure transducer, and liquid sensors, so that the dispense system functions in operation to provide chemical reagent liquid to the downstream destination, free of the presence of gas that would otherwise represent a contaminant in the dispensed liquid, and interfere with the downstream fluid utilization process.

Figure 12:
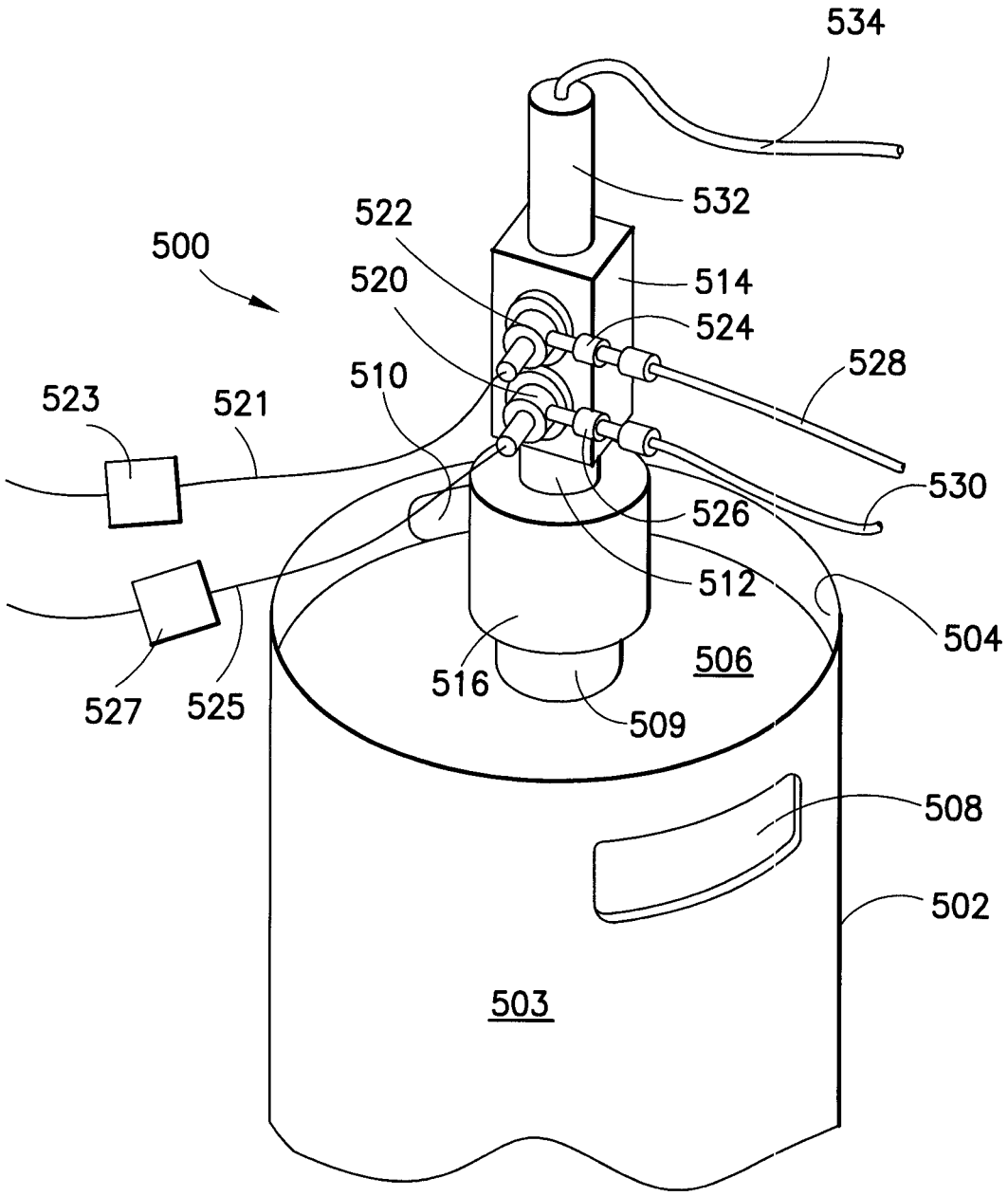
FIG. 12 is a schematic perspective view of the connector and valve/pressure transducer assembly mounted on a fluid storage and dispensing package, of a type as employed in the dispensing system of FIG. 10.

FIG. 12 is a schematic perspective view of the connector and valve/pressure transducer assembly mounted on a fluid storage and dispensing package, of a type as can be employed in the dispensing system of FIG. 10 or stand alone to address headspace removal and empty conditions.

As shown in FIG. 12, the fluid storage and dispensing package 500 includes a container 502 with a circumscribing wall 503 and a cover 506 that together enclose an interior volume in which a fluid material is held in a liner. The wall 503 has an upper portion 504 with diametrally opposite openings 508 and 510 therein, enabling the container to be manually gripped with fingers extended through the respective openings. Extending upwardly from cover is a central neck portion 509 surrounding an opening into the interior volume of the container. The opening in central neck portion 509 communicates with the liner.

Coupled with the neck portion 509 is a connector 516 that is matably engageable with the neck portion. The connector is equipped to communicate through a fluid passage therein with the liner in the container. The connector also has a fluid passage therein for flow of a pressurizing gas into the container, into the space between the liner and wall 503, to exert pressure on the liner causing it to compact and dispense fluid when pressurizing gas is introduced for pressure dispense operation.

The connector 516 is coupled with block valve 514 by coupling 512 to enable fluid from the liner that is flowed through the connector to enter the block valve and flow through chemical supply valve 520 to a chemical reagent dispense line that may be joined to such valve (not shown in FIG. 12). A pneumatic drive gas line 530 is connected to the chemical supply valve 520 by a fitting 526, to actuate and deactuate valve 520.

Also communicating with the liner through the connector and coupling 512 is headspace removal valve 522 in the block valve. The headspace removal valve 522 is connectable to a headspace discharge line (not shown in FIG. 12) and serves to exhaust the headspace gas from the liner to provide a zero headspace or near-zero headspace conformation of the liner for liquid dispensing. A pneumatic drive gas line 528 is connected to the chemical supply valve 522 by a fitting 524, to actuate and deactuate valve 522.

The FIG. 12 system includes a gas discharge line 521 containing a bubble/liquid detection device 523 therein. The bubble/liquid detection device can be of any suitable type, such as an RF sensor, a light sensor or a proximity switch on the gas discharge line, to sense when headspace has been fully removed or near zero removed. The system also includes a liquid dispense line 525 containing a pressure sensor 527 therein.

Valves 520 and 522 are pneumatic valves that may be provided with compressed gas for operation, from any suitable source of drive gas, such as an air compressor, compressed air tank, etc.

The connector 516 as mentioned also has a passage therethrough, connectable with a source of pressurizing gas, for exerting force exteriorly on the liner for dispensing (structural features not shown in FIG. 12 for ease of representation).

The pressure of fluid dispensed from the liner is monitored in the FIG. 12 package by pressure transducer 532 which converts the pressure sensing into a pressure signal that is transmitted by pressure signal transmission line 534 to a CPU or controller, e.g., as shown and described with reference to FIG. 10.

Figure 13:
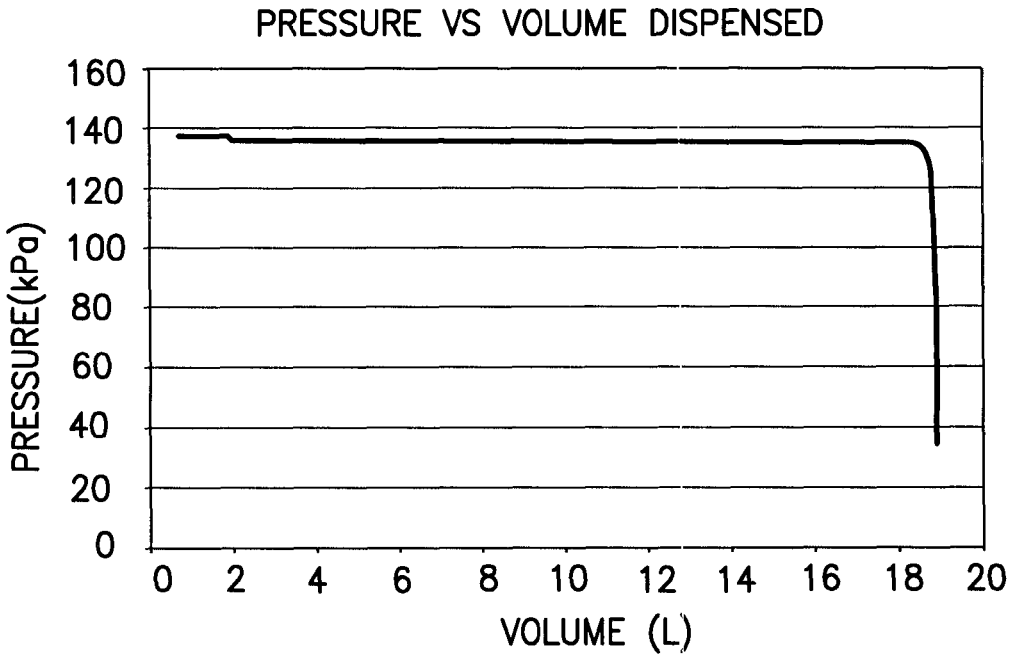
FIG. 13 is a graph of pressure of the dispensed fluid, in kPa, as a function of dispensed volume, in liters, for a pressure dispenser package according to one embodiment of the invention.

During dispensing from such package, the pressurizing gas can be introduced so that the pressure of the dispensed chemical reagent is maintained substantially constant with time, as shown in the graph of FIG. 13, of pressure of the dispensed fluid, in kPa, as a function of dispensed volume, in liters, wherein the dispense pressure is maintained substantially in the vicinity of 136-138 kPa during the dispense operation.

As shown in FIG. 13, after the approximately 18 liters of chemical reagent is dispensed from the liner in the package, the pressure drops rapidly as the liquid is exhausted. Such pressure drop may be monitored by the pressure transducer shown in FIG. 12, as a method of empty detection, to effect switch-out of the container and placement of a fresh container in on-stream dispensing mode.

Figure 14:
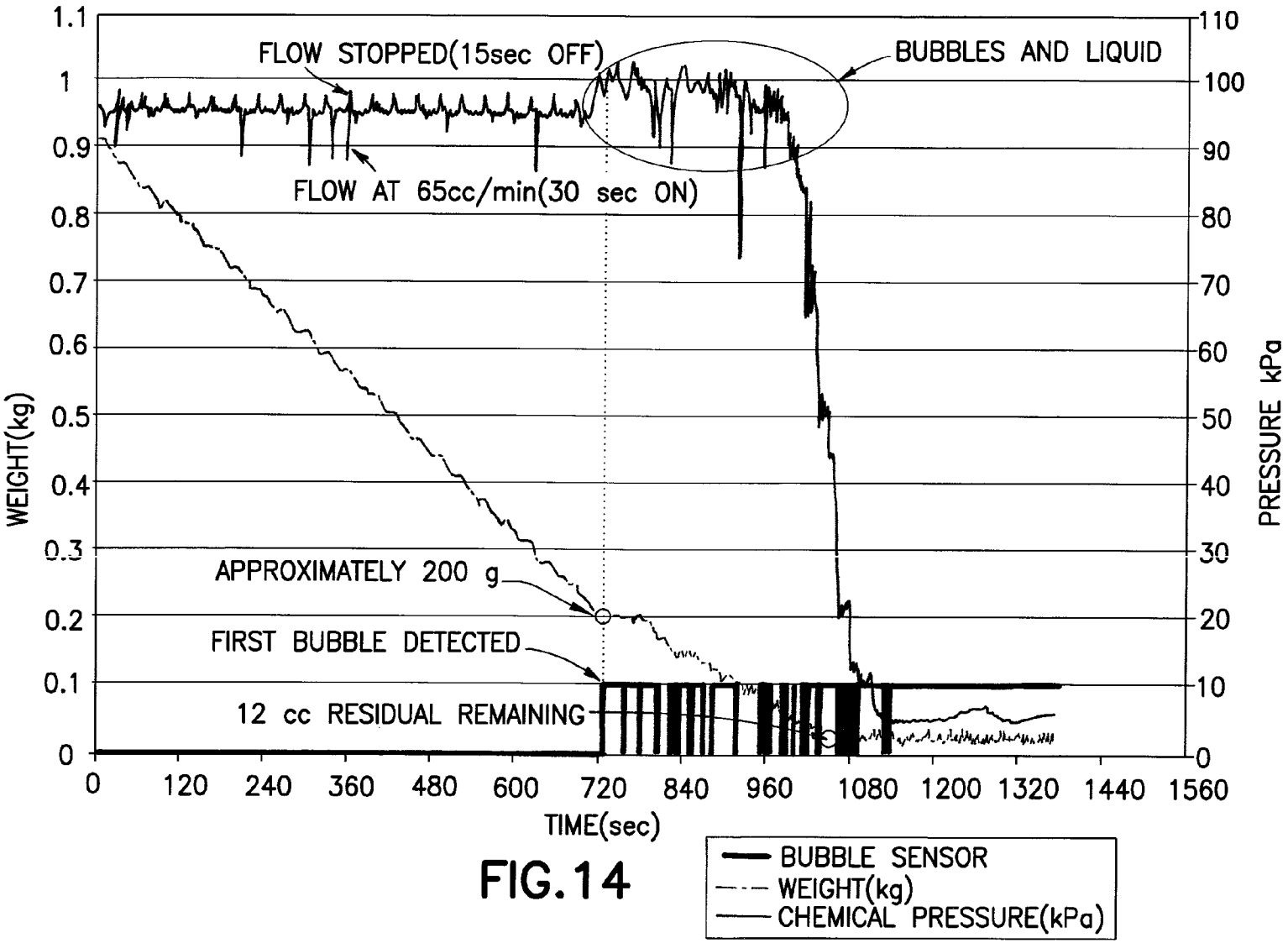
FIG. 14 is a graph of package weight, in kilograms (kg), and dispensed fluid pressure, in kiloPascals (kPa), as a function of time, in seconds, for a system of the type shown in FIG. 10, utilizing a bubble sensor for detection of the approach to empty state of the container.

FIG. 14 is a graph of package weight, in kilograms (kg), and dispensed fluid pressure, in kiloPascals (kPa), as a function of time, in seconds, for a system of the type shown in FIG. 10, utilizing a bubble sensor for detection of the approach to empty state of the container. In the graph of FIG. 14, curve A is the bubble sensor curve, curve B is the container weight curve, and curve C is the dispensed fluid pressure curve.

As shown in FIG. 14, the initial weight of the container is approximately 0.91 kg, and such weight declines to about 0.2 kg at 720 seconds, when the first bubble is detected by the bubble sensor. After about 1040 seconds of dispensing operation, the amount of residual chemical in the package is on the order of 12 cc. Between 720 and 1040 seconds, the dispensed fluid pressure curve undergoes some oscillation due to the presence of bubbles and liquid, with the "droop" of the pressure curve, involving a progressively more rapidly increasing rate of decline of dispensed fluid pressure in such time-frame, indicating the onset of exhaustion of the liquid from the package. The exhaustion of the dispensable liquid from the package follows, as the pressure of the dispensed fluid rapidly drops to about 0.25 kPa.

Such pressure droop behavior thus can be monitored by the system, and the occurrence of same can be utilized to effect changeover from the exhausted container to a fresh container holding the liquid for dispensing service.

The present invention therefore addresses several issues including headspace removal, empty detect and continuous, efficient dispense.

Headspace removal. The prior art uses a separate reservoir located between package and tool to handle headspace gas and any other microbubble gas that gets into liquid in the package. The present invention contemplates two separate approaches that address headspace gas at the package. The first is the solution illustrated in FIG. 12 that uses two valves, one connected to the liquid dispense line and one connected to a gas discharge line, further including a pressure sensor. On the gas dispense line is a bubble or liquid sensor that senses when the headspace gas is taken out and is transitioning to liquid. The sensor indicates this transition and the system switches the gas discharge valve off and the liquid dispense line on allowing the package to dispense. A second approach utilizes a mechanical valve of the type shown in FIGS. 2-6, which can be incorporated into the FIG. 12 approach, but will eliminate the need for the second valve for gas discharge. In this case, the mechanical valve handles the microbubbles and headspace gas as previously described.

Figure 19:
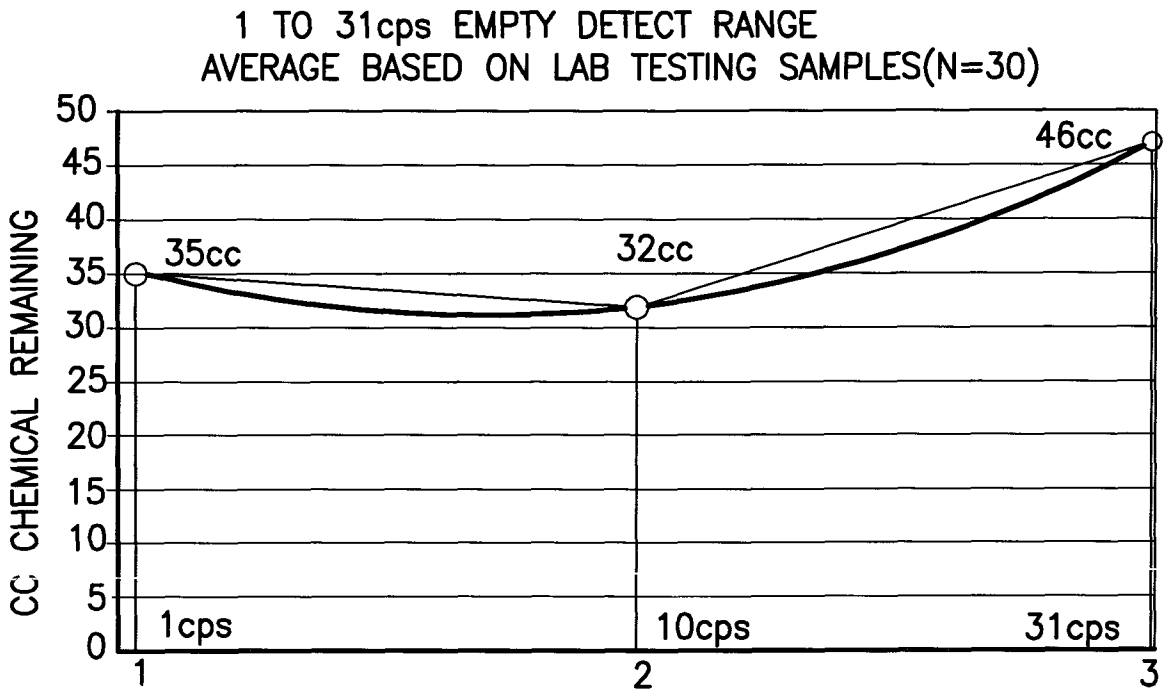
FIG. 19 is a graph of cubic centimeters (cc) of chemical remaining in a supply container versus fluid viscosity in centipoise (cps) upon sensing of an empty condition via pressure measurement using an apparatus according to a specific embodiment.

Empty Detect. The prior art uses scales to weigh packages to know when an empty condition is approaching. This approach wastes a substantial amount of material. The embodiment of FIG. 12 also uses a pressure sensor to compare pressure of liquid with pressure from the pressurizing gas that is introduced into the outer pack. The pressures are kept equivalent. When there is a pressure drop such that the pressure of the liquid being dispensed drops even as the gas pressure is held constant, the system senses this change and shuts off or does an A to B switch (or uses a capture container to take the remainder). In such an embodiment, Applicants have found that the pressure drop incident to an empty condition bears some relation to the viscosity of the fluid that is the subject of pressure measurement. A graph depicting chemical remaining in a supply container (in of cubic centimeters (cc)) versus fluid viscosity (in centipoise (cps)) upon sensing of an empty condition via pressure measurement according to a specific embodiment of the invention is provided in FIG. 19. As shown, the volume of fluid remaining in the liner is relatively constant (actually experiencing slight decline) from 1-10 centipoise, but as viscosity increases from 10-31 centipoise, the volume of remaining fluid follows an increasing trend. In another embodiment, a bubble sensor or particle count detection device is employed to sense an empty detect condition, as in the embodiment of FIG. 7.

Figure 15:
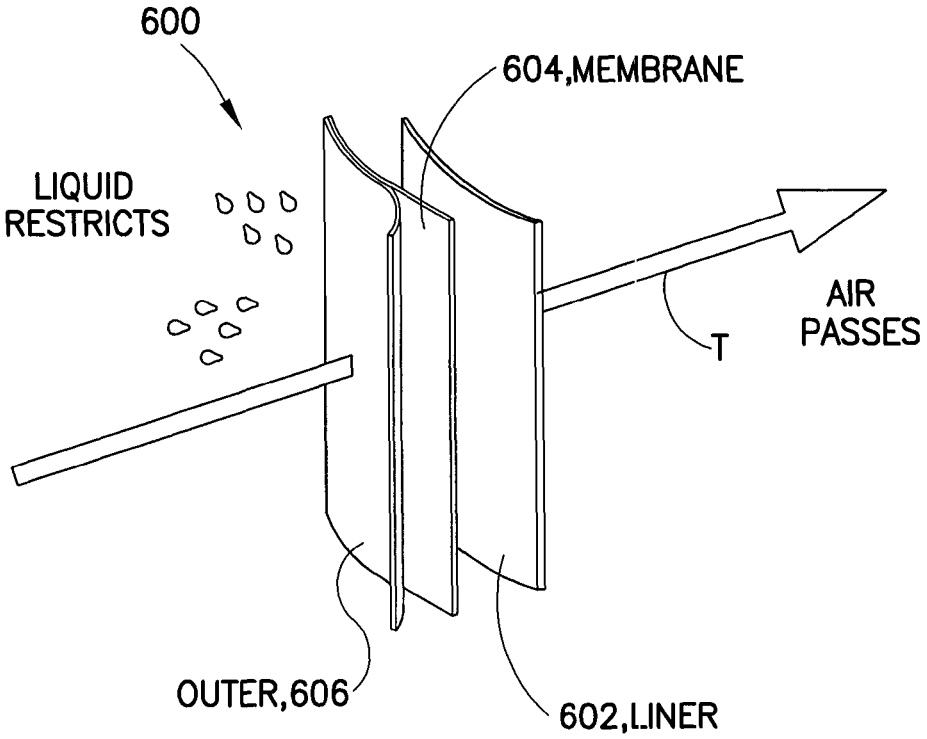
FIG. 15 is a perspective view of a multilayer laminate usefully employed in a liner-based material storage and dispensing package, according to a specific embodiment of the invention.

FIG. 15 is a perspective view of a multilayer laminate that can be used in conjunction with gas removal to eliminate transfer of liquid and waste. The membrane is designed to allow the passage of air but not liquid. Such laminate is usefully employed in a liner-based material storage and dispensing package, according to one specified embodiment of the invention. The multilayer laminate 600 includes a liner film (e.g., fluoropolymers such as polytetrafluoroethylene (PTFE) and perfluoroalkoxy (PFA) and copolymers including monomers of such polymers), an intermediate membrane 604, and a third or outer layer 606.

As shown in the specific illustrated embodiment of FIG. 15, the laminate is permeable to air, whose direction of permeation from an exterior environment of the liner is shown by the arrow "T". By the provision of this laminate, atmospheric moisture and liquid materials are prevented from penetrating into the material held in the liner by the outer layer. Air can permeate through the multilayer structure, but such air influx can readily be removed from the liner contents at the point of use by the headspace and bubble/microbubble removal schemes described hereinabove.

It will therefore be appreciated that the packages of the present invention can be fabricated and constituted in a wide variety of forms, and may have associated therewith bubble sensors, end point (empty) detectors, pressure-monitoring equipment, connectors, flow circuitry, and process controllers and instrumentation, in various embodiments thereof.

Further, the materials held in packages of the present invention, e.g., in liners in liner-based packages, may be widely varied and constitute not only liquids per se, but also liquid-containing materials, e.g., suspensions and slurries, as well as other flowable and non-flowable materials. For example, the contained material may comprise a semiconductor manufacturing chemical reagent, such as a photoresist, chemical vapor deposition reagent, cleaning composition, dopant material, chemical mechanical polishing (CMP) composition, solvent, etchant, passivating agent, surface-functionalizing reagent, or other material having utility in the manufacture of microelectronic device products.

The invention in another aspect relates to a connector adapted to be coupled to a port of a liquid container for dispensing of liquid therefrom, in which the connector includes a main body portion with a downwardly extending probe, for creating a gas/liquid tight seal between the connector and the container liner.

The main body portion includes a reservoir, and the probe includes a conduit extending upwardly into the reservoir and terminating at an upper end therein below an upper end of the reservoir, so that liquid flowing upwardly through the probe passes through the conduit and flows from the upper end thereof into the reservoir, for disengagement in the reservoir of gas from the liquid, to form a liquid level interface between the liquid and the gas in the reservoir.

A low liquid level sensor is positioned in a lower portion of the reservoir operatively coupled with a gas discharge valve, for discharging gas from the reservoir. In like manner, a high liquid level sensor is positioned in an upper portion of the reservoir operatively coupled with a liquid discharge valve, for discharging liquid from the reservoir.

A valve controller is operatively coupled with the low liquid level sensor and the high liquid level sensor and is responsively arranged to control the gas discharge valve and liquid discharge valve so as to separate gas from liquid in the reservoir, and to separately discharge the gas and the liquid.

The gas discharge valve and liquid discharge valve in one embodiment are electronic valves, and may be stepper or servo-controlled valves. Alternatively, such valves could be pneumatic valves.

The valve controller in one embodiment comprises an integrated circuit logic controller disposed in the main body portion. A pressure transducer can be disposed in the main body portion and operatively coupled with the valve controller.

In a specific embodiment, the connector further includes a high high liquid level sensor in the upper portion of the reservoir, above an elevation of the high liquid level sensor, operatively coupled with the liquid discharge valve, and a low low liquid level sensor in the lower portion of the reservoir, below an elevation of the low liquid level sensor, operatively coupled with the gas discharge valve, wherein the high high liquid level sensor and the low low liquid level sensor are operatively coupled with the valve controller to further modulate the gas discharge valve and the liquid discharge valve, to avoid presence of gas in liquid discharged from the connector.

Certain embodiments of the invention correspondingly contemplates a liquid dispensing package including a container having a port, and a connector as described above, coupled with the port. Such liquid dispensing package may further include a liner in the container, in which the liner is adapted to hold a chemical reagent for pressure dispensing. The liner may hold a chemical reagent such as a photoresist.

Certain embodiments of the invention contemplate a corresponding use of the connector to dispense liquid from a container, e.g., for manufacture of a microelectronic device.

In another aspect, the invention relates to a method of dispensing liquid from a container, including the steps of: passing the liquid to a gas/liquid separation zone in a connector coupled with the container; monitoring gas/liquid interface position in the gas/liquid separation zone, at a high liquid level position and at a low liquid level position, and responsive to such monitoring, discharging gas and liquid from the gas/liquid separation zone, with continuous discharge of liquid, and with discharge of gas being modulated to maintain the gas/liquid interface between the high liquid level position and the low liquid level position during the continuous discharge of liquid.

The discharged liquid in such method may comprise a chemical reagent such as a photoresist for manufacturing a microelectronic device, such as an integrated circuit or a flat panel display. The liquid in one embodiment of such method is passed to the gas/liquid separation zone by pressure dispensing from the container, e.g., a liner-based container holding the liquid for dispensing.

Figure 16:
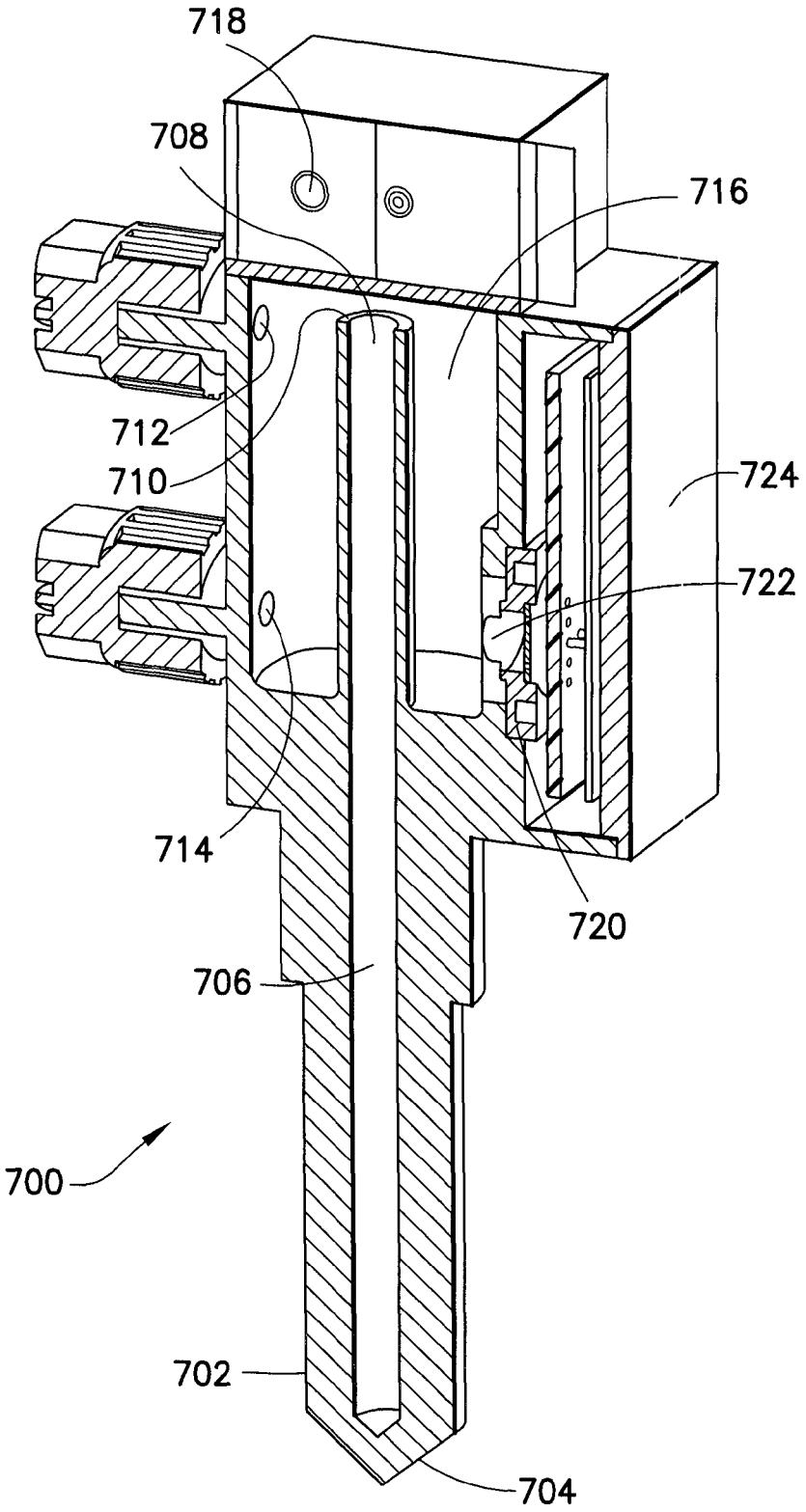
FIG. 16 is a schematic perspective view of a portion of a connector featuring an integrated reservoir for separation of extraneous gas from the liquid to be dispensed from a supply container to which the connector is coupled in use.

Connector with integrated reservoir. FIG. 16 is a schematic perspective view of a portion of a connector featuring an integrated reservoir for separation of extraneous gas from the liquid to be dispensed from a supply container to which the connector is coupled in use. Such connector may also be used to facilitate headspace gas removal.

The connector portion 700 includes a probe 702. The probe is constituted by a downwardly extending fluid engagement structure that accommodates upflow of liquid (along with any entrained or dissolved gas) from the container for dispensing, through one or more passages in the structure. A probe of the type shown in FIG. 16 may extend downwardly into the associated container, terminating at a lower end that is in an intermediate or upper portion of the container interior volume. Such relatively short probe structures are sometimes referred to as "stubby probes," in contrast to elongate probes that may be sized and constructed to extend downwardly to a lower portion of the container interior volume, in the manner of the dip tube shown in FIG. 1. The probe creates a gas/liquid-tight seal to the upper part of a supply package, e.g., a liner-based liquid supply package, when the fully assembled connector is coupled therewith.

The probe 702 includes a lower end 704 into which liquid enters during the dispense operation and a central conduit 706 communicating with the reservoir 716 of the body 724 of the connector portion. The central conduit 706 has a central bore 708 accommodating upward gas/liquid flow, and an open upper end 710, allowing the upflowing gas/liquid during the dispense operation to overflow the upper end and issue into the reservoir.

The reservoir has two sensors arranged therein for sensing high liquid level and low liquid level. The low level sensor 714 is arranged in sensing relationship to liquid in the reservoir that contacts it, and may be coupled with a suitable signal transmission line for outputting of a control signal to controllers for the stepper or servo controlled valves (not shown in FIG. 16) of the connector, and processing involving the integrated circuit logic 720. The reservoir also has disposed therein a high liquid level sensor 712 that is at an elevation in the reservoir 716 in proximity to the open upper end 710 of the conduit 706.

The reservoir also has disposed therein a pressure transducer 722, for monitoring pressure of the fluid in reservoir 716. Such pressure transducer serves to detect an empty condition in the supply container. The reservoir 716 is coupled in gas flow communication with a gas egress passage 718 in the body 724 of the connector portion.

The integrated reservoir thus is provided in the connector body, and acts in operation as a trap for the accumulation of gas deriving from accumulation of bubbles from folds in the liner, headspace gas from the liner, and ambient air or other gases that permeate through the liner into the interior volume thereof during the dispensing cycle.

Figure 3:
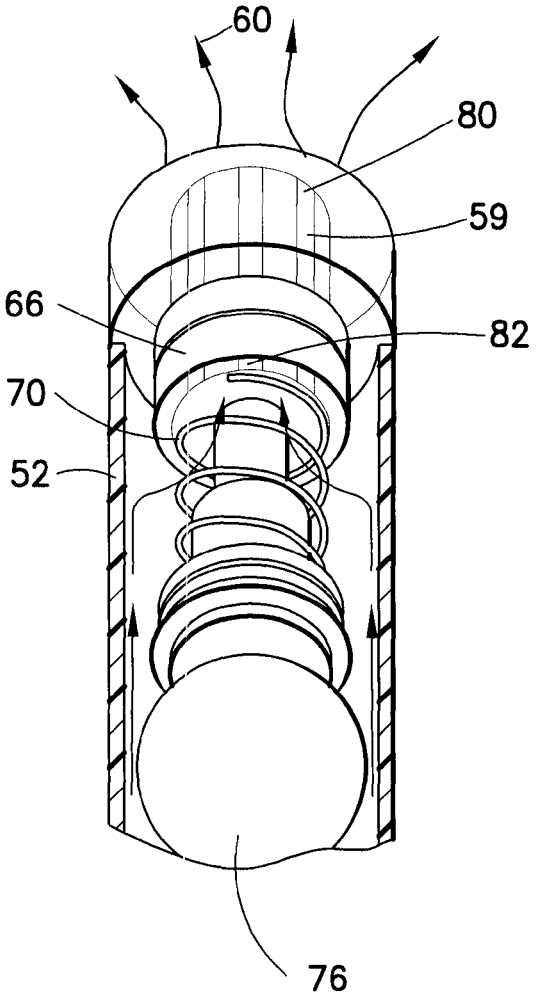

The reservoir can also be equipped with a gas disengagement tube of a type described in connection with FIG. 3 hereof, if desired.

Figure 17:
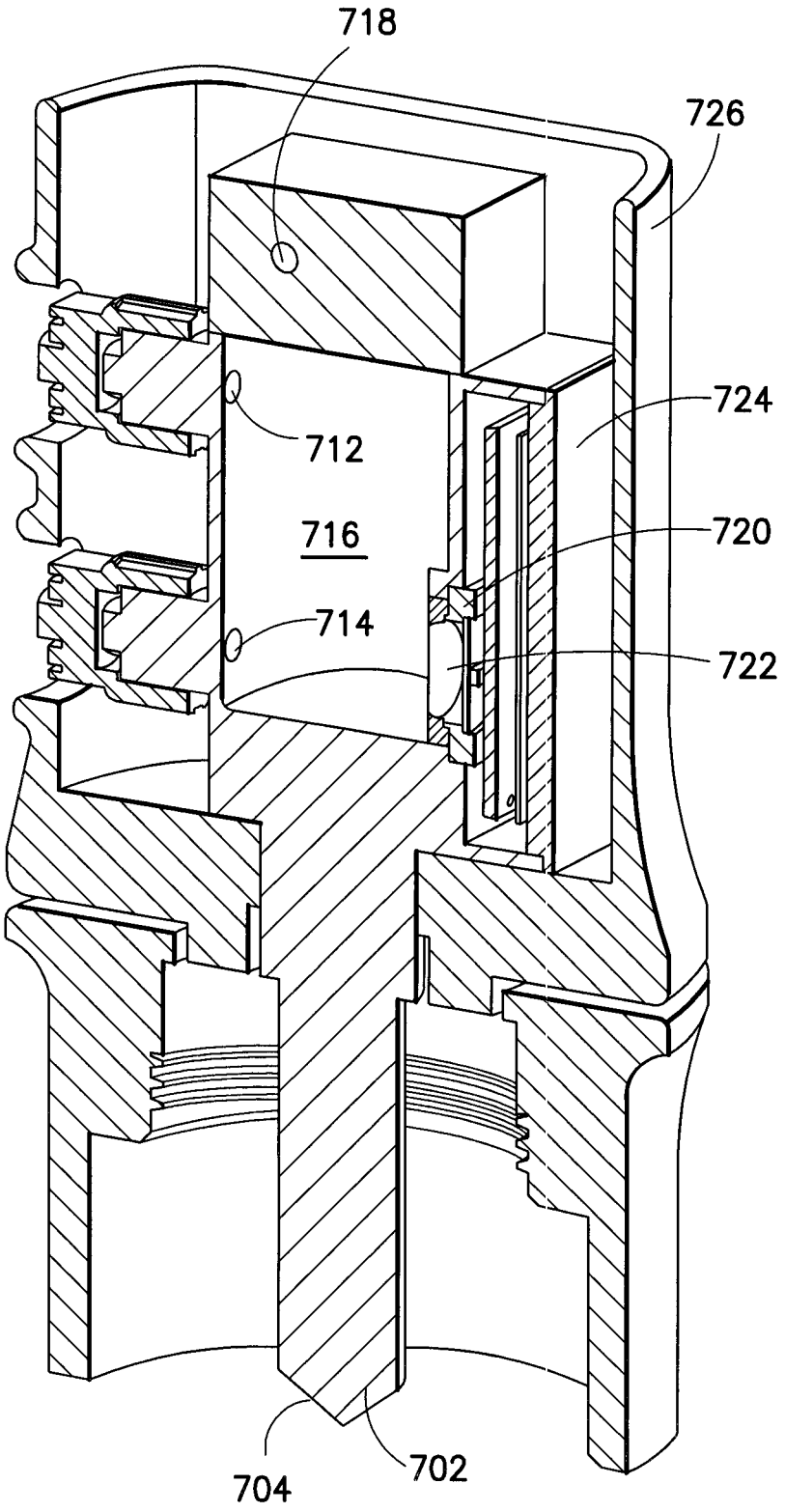
FIG. 17 is a schematic perspective view of a connector including the portion shown in FIG. 16.

FIG. 17 is a schematic perspective view of a connector 726 including the portion shown in FIG. 16. As illustrated, the body 724 of the connector portion is mounted in the connector housing, as adapted for coupling with a port of the container from which the connector will effect liquid dispensing to a downstream liquid-utilizing apparatus, such as a microelectronic process tool. All parts and components of the connector portion shown in FIG. 16 are correspondingly numbered in FIG. 17.

Figure 18:
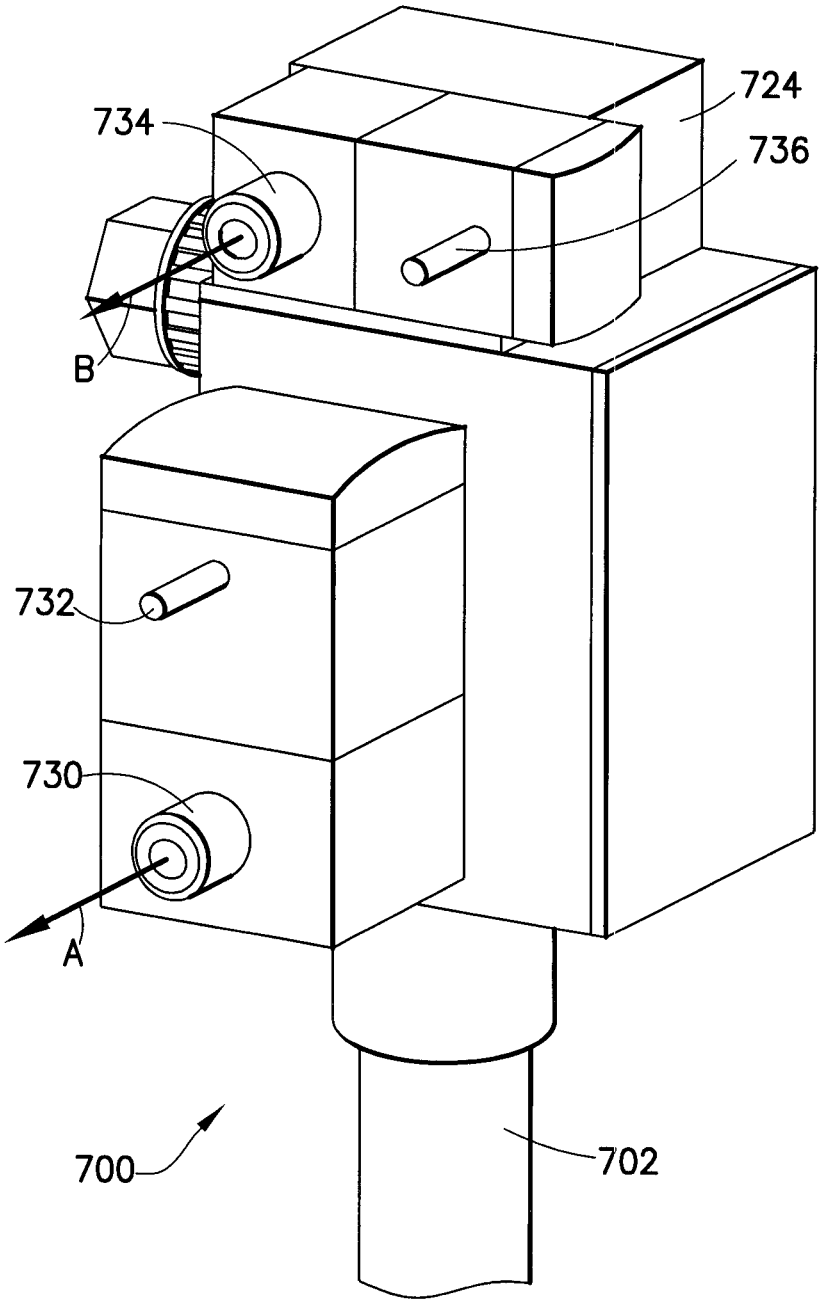
FIG. 18 is a schematic perspective view of a portion of a connector including the portion shown in FIG. 16, as assembled with stepper or servo-controlled valves for dispensing operation.

FIG. 18 is a schematic perspective view of a portion of a connector including the portion shown in FIG. 16, as assembled with stepper or servo-controlled valves for dispensing operation.

The connector portion 700 as illustrated features the probe 702 downwardly extending from the body 724, with the parts and components in the assembly shown in FIG. 18 being correspondingly numbered to the same parts and components in FIG. 16. The connector portion includes stepper or servo-controlled valves 734 and 730, adapted for discharge of gas (in the direction indicated by arrow B) and liquid (in the direction indicated by arrow A), in operation. Valve 734 is coupled with the gas discharge opening 718 shown in FIG. 16, to discharge the unwanted gas contacting or separated from the liquid to be dispensed. Valve 734 is actuated by power supplied to the valve by power line 736. Valve 730 is adapted to discharge liquid passing through the probe 702, for dispensing to a downstream liquid-utilizing apparatus or installation. The valves 734 and 730 may be provided with couplings, quick-disconnect connectors, locking structures, etc., as adapted for connecting of the valve to associated flow circuitry or other fluid discharge structures. The liquid discharge valve 730 is actuated by power supplied to the valve by power line 732.

The provision of stepper or servo-controlled valves eliminates the necessity for pneumatic lines, and accommodates electronic control to provide flow rate functionality to the connector. An integrated circuit logic can be provided, as shown, in the body of the connector, or alternatively may be provided in a separate structure. The integrated circuit logic communicates to the electronic valves 734 and 730, to cause such valves to close, or to open fully or to an intermediate extent, as desired.

The embodiment shown in FIGS. 16-18 employs two sensors for high liquid and low liquid sensing. These sensors indicate to the integrated circuit logic interface how much headspace is in the reservoir. The sensor 712 at the top of the reservoir indicates when to close the associated headspace removal valve. The sensor at the lower portion of the reservoir indicates that too much air is in the reservoir and to open the headspace removal valve. In both cases, the liquid discharge line to the downstream liquid-utilizing apparatus or facility is used as a toggle, so that when one valve is opened, the other valve is closed, and vice versa. The liquid discharge valve and the high sensor valve can be opened at the same time to eliminate liquid discharge starvation involving inadequate flow of dispensed liquid to the downstream apparatus or facility.

In one embodiment, only one sensor is employed to open in both liquid and gas valves when air is sensed at the top of the reservoir. It will be recognized that the connector may be variously configured, for such purpose.

In another embodiment, four sensors are used to ensure an additional level of safety in dispensing and the avoidance of air in the discharged liquid. The sensors include (i) a high sensor, (ii) a high, high sensor, (iii) a low sensor and (iv) a low, low sensor, with the high, high sensor (ii) being located at an upper portion of the reservoir, above the high sensor (i), and with the low, low sensor (iv) being located at a lower portion of the reservoir, below the low sensor (iii).

In another embodiment, a method for dispensing liquid from a pressure dispense package employs a ventable reservoir, a sensor (such as a capacitive sensor, photosensor, and/or optical sensor), and a gas control element. Such a method includes supplying a gas-containing fluid to a ventable reservoir having a gas outlet disposed at a first level and having a liquid outlet disposed at a second level below the first level, sensing a condition in which a pocket of gas has accumulated along an upper portion of the ventable reservoir and responsively generate a sensor output signal, operating a gas control element to effect removal of said gas from said ventable reservoir responsive to said sensor output signal, and delivering liquid through the liquid outlet. The liquid delivering step may be interrupted as gas is removed from the reservoir. The sensing and operating steps may be repeated multiple times prior to complete dispensation of liquid contents from the pressure dispense package. Such method steps may be desirably performed with the apparatuses of FIG. 20A-20C or 21A-21B.

Figure 20A:
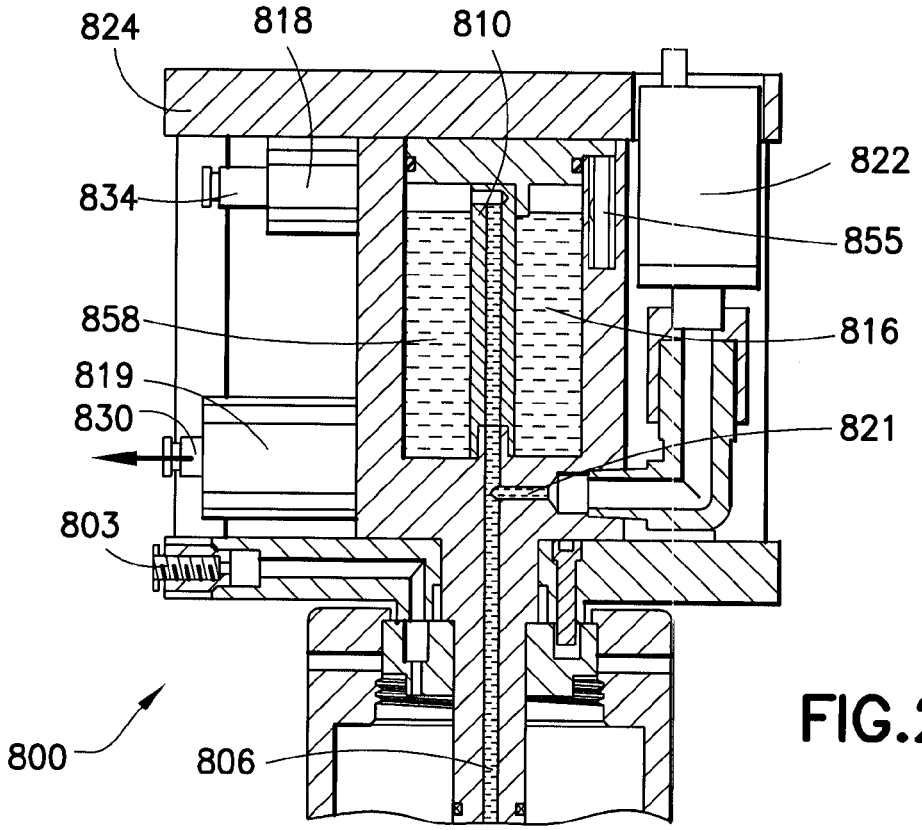
FIGS. 20A-20C are schematic side cross-sectional views of at least a portion of a connector adapted for pressure dispensation according to a specific embodiment, the connector featuring an integrated reservoir and a sensor adapted to sense a condition in which a gas pocket has accumulated along an upper portion of the ventable reservoir, to permit gas to be periodically and automatically expelled from the reservoir during dispensing operation, with FIGS. 20A-20C depicting the connector portion in three sequential operating states.
Figure 20B:
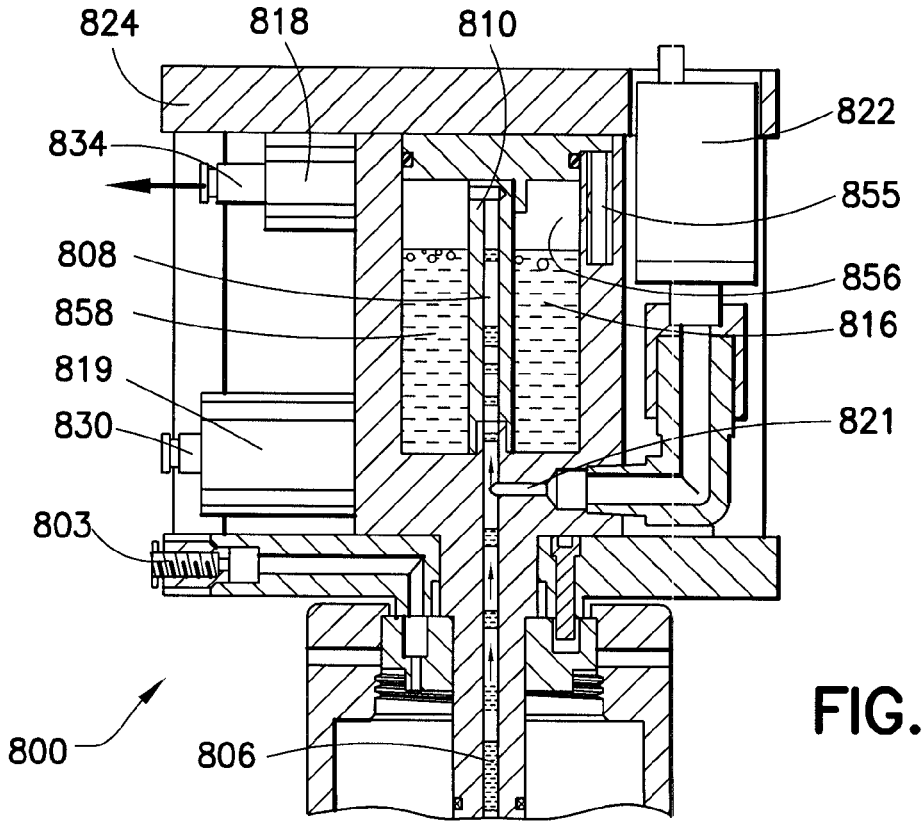
Figure 20C:
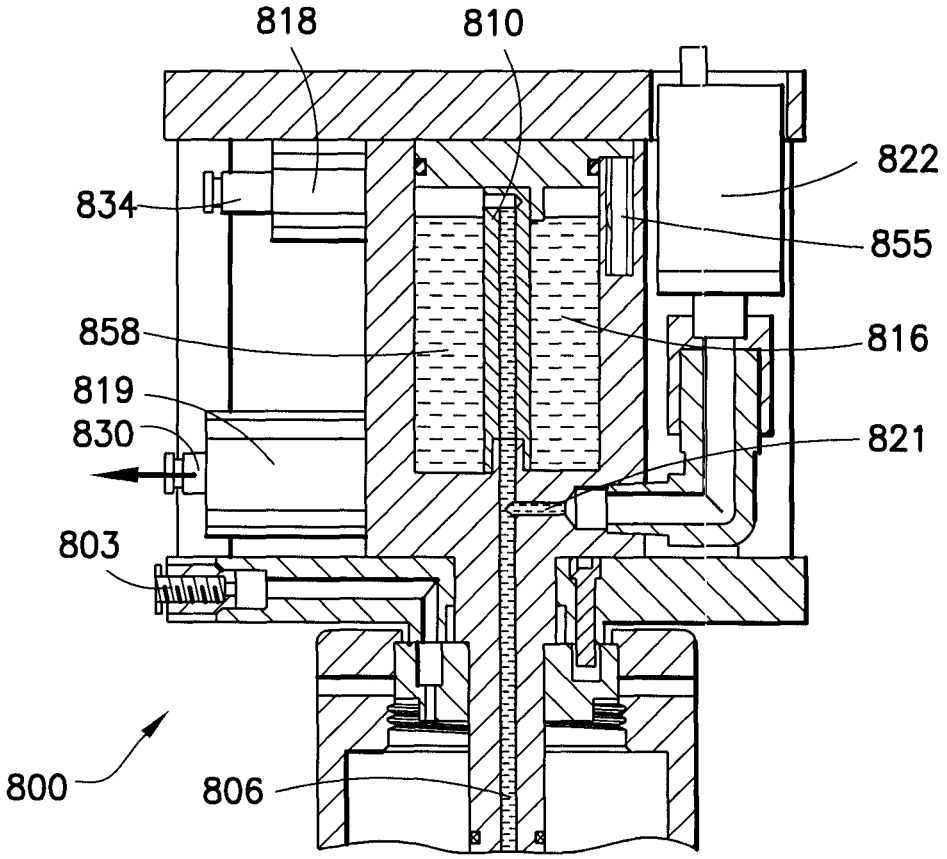
Figure 21A:
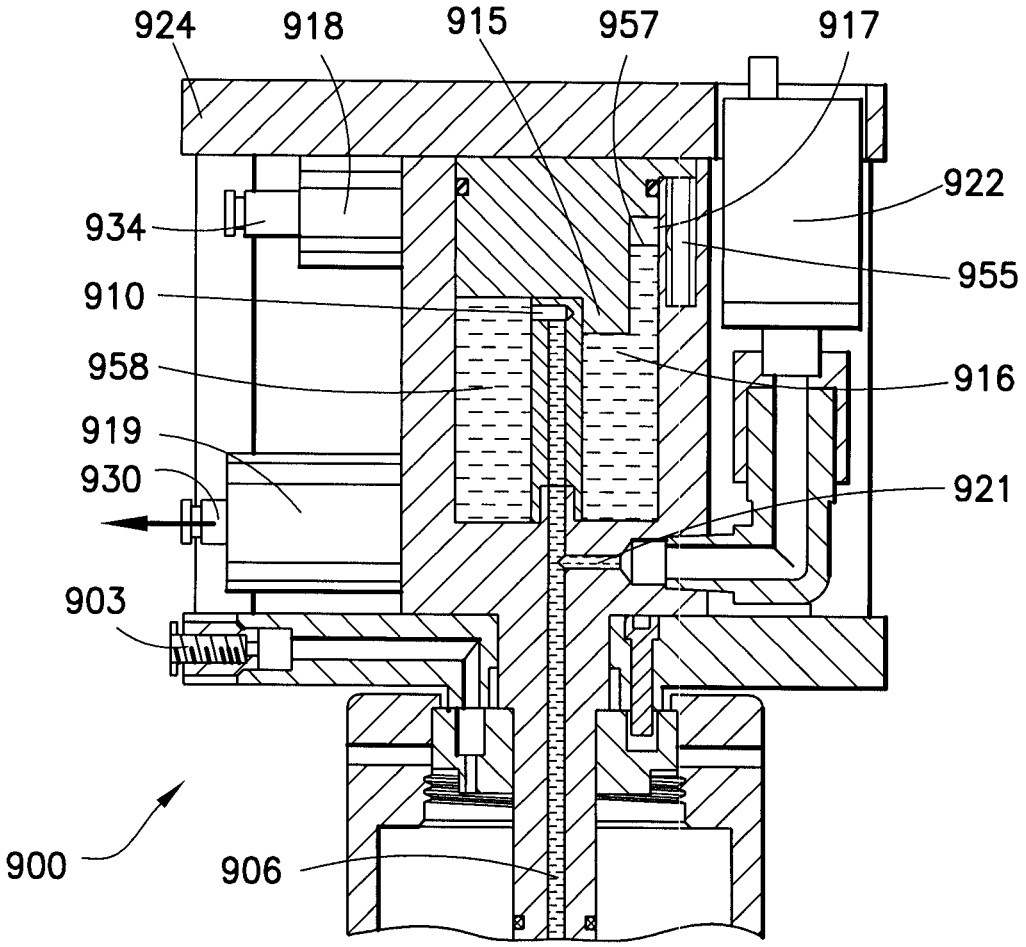
FIG. 21A is a schematic side cross-sectional view of at least a portion of a connector adapted for pressure dispensation according to another specific embodiment, the connector featuring an integrated reservoir with a baffle and reduced cross-section gas collection zone, with a sensor adapted to sense a condition in which a gas pocket has accumulated in the gas collection zone, to permit such gas to be periodically and automatically expelled from the reservoir during dispensing operation.
Figure 21B:
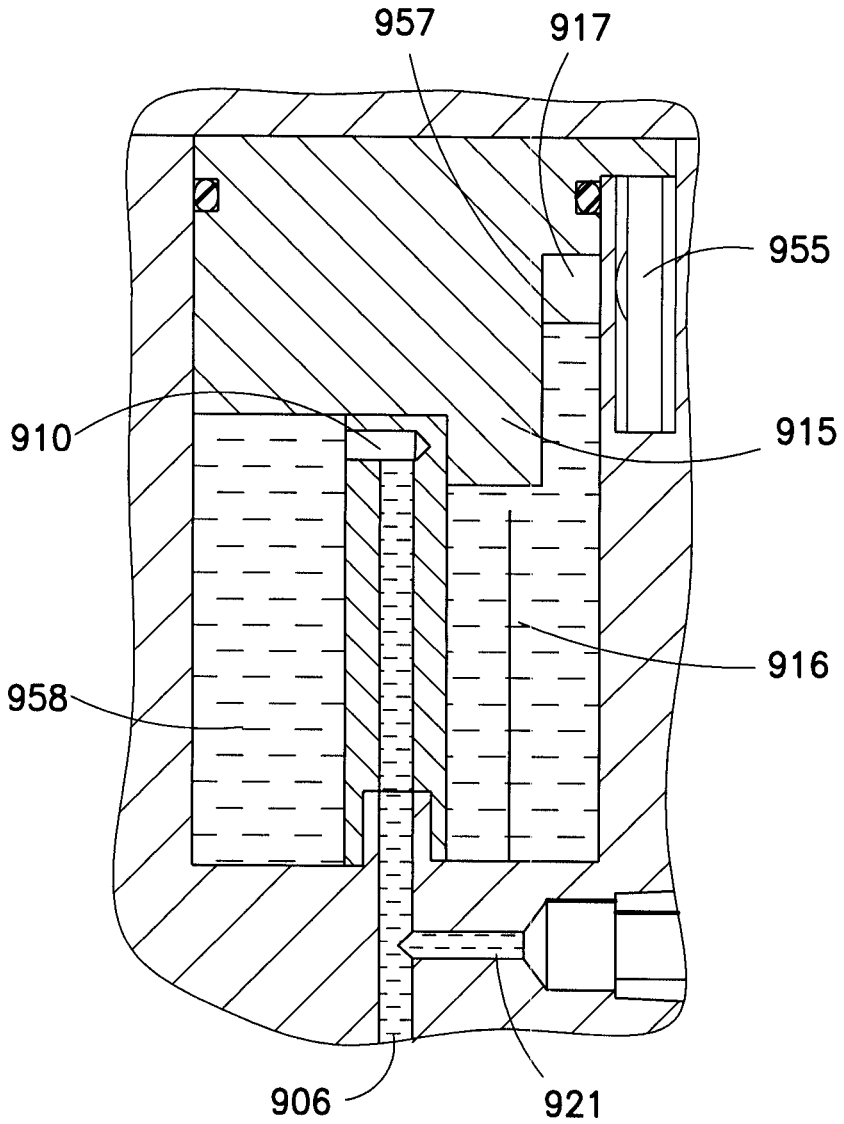
FIG. 21B is an expanded side cross-sectional view of a portion of the connector of FIG. 21A.

FIGS. 20A-20C are schematic side cross-sectional views of at least a portion of a connector 800 according to a another embodiment featuring an integrated reservoir 816 and a sensor 855 proximate to a gas-liquid interface within the reservoir to permit gas to be periodically and automatically expelled from the reservoir during dispensing operation. Such expulsion of gas, which may be performed one or more after initial liquid dispensation has commenced, may be termed "auto-burp" operation.

Although not shown, the connector 800 may include an optional probe as described hereinabove. The connector 800 includes a central conduit 806 communicatively coupled between a container and/or liner (not shown) and the reservoir 816 disposed within the body 824 of the connector 800. The central conduit 806 has a central bore 808 accommodating upward gas/liquid flow, and an open upper end 810 allowing the upflowing gas/liquid during dispensing operation to overflow the upper end 810 and issue into the reservoir 816. As the connector 800 is desirably used with a pressurized dispense apparatus, it includes a pressurized gas supply line 803 for use in promoting dispensation from a fluid-containing collapsible liner.

A gas outlet conduit 818, which is in fluid communication with the reservoir 816 at an upper portion thereof, is communicatively coupled to an actuatable gas outlet valve 834. A corresponding liquid outlet conduit 819 is in fluid communication with the reservoir 816 at a lower portion thereof and is communicatively coupled to an actuatable liquid outlet valve 830. The upper end 810 of the conduit 806 is preferably disposed at a level between the gas outlet conduit 818 and the liquid outlet conduit 819.

Two sensors are illustrated in FIGS. 20A-20C, namely, a pressure transducer 822 (having an associated inlet 821 communicatively coupled to the central conduit 806 or the reservoir 816) and a sensor 855 adapted to sense a condition in which a gas pocket 856 (as illustrated in FIG. 20B) has accumulated along an upper portion of the reservoir 816. The sensor 855 may be selected to generate an output signal of any of, for example, presence of a gas, absence of a gas, presence of a liquid, absence of a liquid, presence of a bubble, and presence of a liquid-gas interface.

In a preferred embodiment, the sensor 855 is a capacitive sensor adapted to sense the presence of fluid based on dielectric strength. Capacitive sensors have been tested and optimized with interposing dividers to sense liquid levels of various materials utilized in the fabrication of integrated circuits and electronics (e.g., including materials such as photoresist and color filter materials) in order to enable level sensing without requiring directly fluid-sensor contact. In one embodiment, teachable sensors may be used in conjunction with any desirable interposing material (e.g., polyimide or fluoropolymer such as polytetrafluorethylene) within a connector to likewise avoid direct fluid-sensor contact. Such teachable sensor is desirably a capacitive sensor. In another embodiment, a non-teachable sensor may be used. As an alternative to a capacitive sensor, a photosensor and radiation source (photo eye sensor), or optical sensor may be used for level sensing.

A first state of operation of the connector 800 is shown in FIG. 20A. The reservoir 816 is substantially filled with liquid 858, and the sensor 855 does not detect the presence of any gas pocket above the liquid 858 within the reservoir. Accordingly, the gas outlet valve 834 is closed, since there is no need to vent any gas, and the liquid outlet valve 830 is open to permit liquid 858 to flow from the reservoir 816 to a liquid-consuming process tool (not shown).

During dispensation, however, gas dissolved or otherwise mixed into a supply liquid may be supplied to the reservoir 816, as illustrated in FIG. 20B. Alternating plugs of liquid and gas are visible in the central conduit 806. As gas bubbles, including microbubbles, are introduced into the reservoir 816, such bubbles float upward due to their lower density compared to the surrounding liquid, and accumulate at the upper portion of the reservoir 816 to form a gas pocket 856 bounded from below by liquid 858. Maintenance of a high level of liquid 858 within the reservoir 816 is desirable to reduce the likelihood that bubbles may be entrained in the liquid stream exiting the reservoir 816.

As the gas pocket 856 accumulates within the reservoir 816, the liquid level falls relative to the sensor 855 and triggers an output signal indicative of the changed condition. Responsive to the output signal from the sensor 855, the gas outlet valve 834 opens, thus permitting gas 856 from the upper portion of the reservoir 816 to escape through the gas outlet conduit 818. At the same time, the liquid outlet valve 803 is preferably closed, to permit the gas/liquid interface 857 to rise again as liquid supplied through the central conduit 806 and outlet end 810 fills the reservoir 816.

As the liquid level 857 rises to fill the reservoir 816, the sensor 855 senses the change in condition and generates an output signal that responsively triggers closure of the gas outlet valve 834, as illustrated in FIG. 20C. At the same time, the liquid outlet valve 830 is opened, permitting flow of liquid from the reservoir 816 through the liquid outlet conduit 819 to resume. Such process or periodically "burping" or ejecting gas from the reservoir 816 is repeated automatically as necessary during pressure dispense operation.

Because any gas-liquid interface causes some diffusive mass transport of gas into the liquid and vice-versa (i.e., formation of liquid vapor in the gas), it is desirable to eject gas quickly from such an interface when dispensing pure liquid chemicals to semiconductor process tools and the like.

It is to be appreciated that, while the ventable reservoir 816, valves 830, 834, and sensor 855 of FIGS. 20A-20C are illustrated as being integrated into a connector 800 for coupling to a dispensing container, such elements could be provided downstream of a dispensing container and associated connector—for example, in a standalone automated gas removal or "burping" apparatus.

A connector 900 that is functionally quite similar but has certain enhancements compared to the connector 800 described previously is illustrated in FIGS. 21A-21B. The enhanced connector 900 similarly has a pressurized gas supply line 903, body 924, central fluid supply conduit 906, conduit end 910, gas outlet conduit 918, gas outlet valve 934, liquid outlet conduit 919, liquid outlet valve 930, pressure transducer 922, and pressure transducer conduit 921, and sensor 955, but differs with respect to reservoir geometry. Specifically, the reservoir 916 includes a narrowed gas collection zone 917 and one or more baffles 915, with the sensor being disposed proximate to the gas collection zone 917.

The gas collection zone 917 is disposed at an upper boundary of the reservoir 916 to permit gas bubbles to accumulate into a pocket above a gas-liquid interface 957 prior to being periodically vented. There are numerous advantages to minimizing the width or cross-sectional area (relative to a vertical axis) of the gas collection zone 917. First, a reduced cross-sectional area minimizes the gas-liquid interface, which in turn reduces mass transport between the gas and liquid at the interface 957. Second, the reduced cross-sectional area leads to more rapid movement of the gas-liquid interface 957, which translates into faster response of the sensor 955 to trigger more frequent ventilation of gas from the gas collection zone 917. This also ensures that any resulting gas pocket in the gas collection zone 917 will be small and vented rapidly. The result is not only a smaller air-gas interface 957, but also a reduced interval for such interface 957 relative to the reservoir 816 of the preceding connector 800. Relative to an average internal cross-sectional area of the ventable reservoir 916 perpendicular to a vertical axis, the comparable internal cross-sectional area of the gas collection zone 917 is preferably less than or equal to about one-half such average area; more preferably less than or equal to about one-fourth such average area; and more preferably still less than or equal to about one-eighth such average area.

With regard to the reservoir 916 generally, its shape is desirably selected to promote transport of bubbles and microbubbles to the gas collection zone 917. The more quickly that bubbles can be routed to such zone 917, the less time they will remain in contact with the liquid 958. One or more baffles 915 may be provided in the reservoir to increase the circulation of liquid, and thus cause microbubbles to rise to the gas collection zone 917 to be ejected instead of entering the liquid outlet conduit 919. One or many baffles may be placed in any suitable portion of the reservoir 916 (e.g., along the top, middle, bottom, or sides) to accommodate the desired application, taking into account considerations such as viscosity, flow rate, gas saturation, and pressure. Various computer aided flow modeling tools may be used to select appropriate baffles and reservoir geometries to provide desired results with respect to promoting transport of microbubbles to the gas collection zone.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

What is claimed is:

1. A fluid dispensing system arranged to supply liquid media to a point of use, the fluid dispensing system comprising:

a first pressure dispense package including a first vessel that defines a first dispensing port and that contains a collapsible first liner arranged to hold liquid media susceptible to presence of headspace gas within the first liner, wherein the first dispensing port is in fluid communication with an interior of the first liner;

a first gas removal apparatus configured to remove headspace gas from the first liner while liquid media is being dispensed from the first liner;

a second pressure dispense package including a second vessel that defines a second dispensing port and that contains a collapsible second liner arranged to hold liquid media susceptible to presence of headspace gas within the second liner, wherein the second dispensing port is in fluid communication with an interior of the second liner;

a second gas removal apparatus configured to remove headspace gas from the second liner while liquid media is being dispensed from the second liner; and at least one sensor arranged to detect a condition indicative of exhaustion or approach to exhaustion of liquid media dispensed from at least one of the first pressure dispense package and the second pressure dispense package;

wherein the second gas removal apparatus is arranged to remove headspace gas from the second pressure dispense package while the first pressure dispense package is dispensing liquid media; and wherein the fluid dispensing system is arranged to automatically initiate dispensing of liquid media from the second pressure dispense package following detection by the at least one sensor of a condition indicative of exhaustion or approach to exhaustion of liquid media dispensed from the first pressure dispense package.

2. The fluid dispensing system of claim 1, wherein the first gas removal apparatus comprises a first ventable reservoir arranged to receive liquid media from the first pressure dispense package, and the second gas removal apparatus comprises a second ventable reservoir arranged to receive liquid media from the second pressure dispense package.

3. The fluid dispensing system of claim 2, further comprising at least one filter arranged for any of (1) preventing passage of particles through a flow regulation device associated with at least of the first pressure dispense package and the second pressure dispense package, and ((2) restricting the passage of bubbles into at least one of the first ventable reservoir and the second ventable reservoir.

4. The fluid dispensing system of claim 2, wherein each of the first ventable reservoir and the second ventable reservoir respectively comprises (i) a reservoir sensor arranged to sense accumulation of gas within the respective reservoir, and to responsively generate an output signal indicative of such condition, and (ii) at least one control element adapted to effect removal of gas from the respective reservoir responsive to the output signal.

5. The fluid dispensing system of claim 4, wherein the output signal is indicative of any of: presence of a gas, absence of a gas, presence of a liquid, absence of a liquid, presence of a bubble, and presence of a liquid-gas interface.

6. The fluid dispensing system of claim 4, wherein the sensor comprises at least one of: a capacitive sensor, a photosensor, and optical sensor, and a teachable sensor.

7. The fluid dispensing system of claim 2, wherein each of the first ventable reservoir and the second ventable reservoir separately includes a liquid media inlet, a liquid media outlet, and a gas outlet that is located higher than the liquid media outlet.

8. The fluid dispensing system of claim 2, further comprising a first dispense connector arranged to physically couple with the first vessel and receive liquid media from the first liner, and a second dispense connector arranged to physically couple with the second vessel and receive liquid media from the second liner.

9. The fluid dispensing system of claim 8, wherein the first dispense connector comprises a first dip tube or probe insertable into the first liner, and the second dispense connector comprises a second dip tube or probe insertable into the second liner.

10. The fluid dispensing system of claim 8, wherein the first dispense connector comprises a first ventable reservoir arranged to receive liquid media from the first liner, and the second dispensing connector comprises a second ventable reservoir arranged to receive liquid media from the second liner.

11. The fluid dispensing system of claim 8, wherein the at least one sensor comprises a first sensor associated with the first dispense connector, and a second sensor associated with the second dispense connector.

12. The fluid dispensing system of claim 1, wherein the at least one sensor comprises a pressure sensor arranged to sense pressure of liquid media dispensed from at least one of the first pressure dispense package and the second pressure dispense package to the point of use.

13. The fluid dispensing system of claim 1, wherein the at least one sensor comprises at least one pressure sensor arranged to compare the following items (i) and (ii): (i) pressure of liquid media dispensed from at least one of the first pressure dispense package and the second pressure dispense package to the point of use, and (ii) pressure of gas supplied to at least one of the first pressure dispense package and the second pressure dispense package.

14. The fluid dispensing system of claim 1, wherein the first pressure dispense package and the second pressure dispense package are arranged to receive pressurized gas from at least one a pressurized gas source to promote pressure dispensing of liquid media.

15. The fluid dispensing system of claim 1, wherein the liquid media comprises a chemical reagent and the point of use comprises a liquid media-utilizing process tool.

16. A microelectronic product manufacturing facility comprising the fluid dispensing system of claim 15 arranged to supply a chemical reagent to a microelectronic device process tool or semiconductor process tool.

17. A method for dispensing liquid media to a point of use, the method comprising:

removing headspace gas from a liquid media-containing collapsible first liner arranged within a first vessel of a first pressure dispense package prior to and during the dispensing of the liquid media from the first liner using a first gas removal apparatus;

applying pressure to the first liner to dispense liquid media from the first pressure dispense package; and removing headspace gas from a liquid media-containing collapsible second liner arranged within a second vessel of a second pressure dispense package prior to and during the dispensing of the liquid media from the second liner and while the first pressure dispense package is dispensing liquid media using a second gas removal apparatus to ready the second pressure dispense package for dispensation of liquid media from the second pressure dispense package.

18. The method of claim 17, further comprising detecting a condition indicative of exhaustion or approach to exhaustion of liquid media dispensed from the first pressure dispense package, and responsive to said detection, initiating pressure dispensing of liquid media from the second pressure dispense package to the point of use.

19. The method of claim 18, wherein said detecting of a condition indicative of exhaustion or approach to exhaustion of liquid media dispensed from the first pressure dispense package comprises monitoring pressure of liquid media dispensed from the first pressure dispense package and detecting a pressure droop condition.

20. The method of claim 17, wherein removing headspace gas from the first pressure dispense package comprises flowing headspace gas into a first ventable reservoir associated with the first pressure dispense package and venting gas from the first ventable reservoir, and wherein removing gas from the second pressure dispense package comprises flowing headspace gas into a second ventable reservoir associated with the second pressure dispense package and venting gas from the second ventable reservoir.

21. The fluid dispensing system of claim 1, wherein:

the first gas removal apparatus removes headspace gas from the first liner upon external imposition of gas pressure on the exterior surface of the first liner while liquid media is present in the first liner; and the second gas removal apparatus removes headspace gas from the second liner upon external imposition of gas pressure on the exterior surface of the second liner while liquid media is present in the second liner.

22. The method of claim 17, wherein the step of applying pressure causes the step of removing headspace gas.

* * * * *